US005636543A

United States Patent [19]

Kajiwara et al.

[11] Patent Number: 5,636,543

[45] Date of Patent: Jun. 10, 1997

[54] HOT STEEL PLATE ROLLING MILL SYSTEM AND ROLLING METHOD

[75] Inventors: Toshiyuki Kajiwara, Tokyo; Shigekazu Nagashima; Yasutsugu Yoshimura, both of Hitachi, all of Japan

[73] Assignee: Hitachi, Ltd., Tokyo, Japan

[21] Appl. No.: 203,314

[22] Filed: Mar. 1, 1994

[30] Foreign Application Priority Data

Mar. 18, 1993 [JP] Japan ..... 5-058769
Aug. 31, 1993 [JP] Japan ..... 5-215473

[51] Int. Cl.[6] ..... B21B 1/26

[52] U.S. Cl. ..... 72/234; 72/365.2

[58] Field of Search ..... 72/199, 234, 365.2, 72/366.2, 39, 227, 252.5

[56] References Cited

U.S. PATENT DOCUMENTS

| | | | |
|---|---|---|---|
| 1,810,167 | 6/1931 | George | 72/34 |
| 4,491,006 | 1/1985 | Ginzburg et al. | 72/227 |
| 4,599,883 | 7/1986 | Ginzburg et al. | 72/234 |
| 4,721,153 | 1/1988 | Sano et al. | 164/448 |
| 5,036,689 | 8/1991 | Sekiya et al. | 72/39 |
| 5,365,764 | 11/1994 | Kajiwara et al. | 72/237 |

FOREIGN PATENT DOCUMENTS

| | | |
|---|---|---|
| 0241919A2 | 10/1987 | European Pat. Off. . |
| 0266564A3 | 5/1988 | European Pat. Off. . |
| 0484882A1 | 5/1992 | European Pat. Off. . |
| 0555882A1 | 8/1993 | European Pat. Off. . |
| 57-009510 | 1/1982 | Japan . |
| 57-009512 | 1/1982 | Japan . |
| 57-75201 | 5/1982 | Japan . |
| 58-32502A | 2/1983 | Japan . |
| 58-44903 | 3/1983 | Japan . |
| 58-100903A | 6/1983 | Japan . |
| 59-009004 | 1/1984 | Japan . |
| 59-127902 | 7/1984 | Japan . |
| 60-141305 | 7/1985 | Japan . |
| 61-17305A | 1/1986 | Japan . |
| 61-56708 | 3/1986 | Japan . |
| 61-108405A | 5/1986 | Japan . |
| 61-140303A | 6/1986 | Japan . |
| 61-088907 | 9/1986 | Japan . |
| 62-3816 | 1/1987 | Japan . |
| 62-68616 | 3/1987 | Japan . |
| 62-192206 | 8/1987 | Japan . |
| 63-104713A | 5/1988 | Japan . |
| 63-140705A | 6/1988 | Japan . |
| 63-207403 | 8/1988 | Japan . |
| 63-286203 | 11/1988 | Japan . |
| 1-166802A | 6/1989 | Japan . |
| 1309704 | 12/1989 | Japan . |
| 3013218 | 3/1991 | Japan . |
| 3090270 | 4/1991 | Japan . |
| 4-46608 | 2/1992 | Japan . |
| 4-284902 | 10/1992 | Japan . |

OTHER PUBLICATIONS

Tomoaki Kimura and Nobuhiro Fujino, "Recent Developments for Advanced Rolling Mills", *Hitachi Review, vol. 37,* (1988), No. 4, pp. 175–180.

*Primary Examiner*—Lowell A. Larson
*Assistant Examiner*—Thomas C. Schoeffler
*Attorney, Agent, or Firm*—Evenson McKeown Edwards & Lenahan, PLLC

[57] ABSTRACT

A mill including large-diameter work rolls which are directly driven is disposed in an upstream stage of a hot strip finish rolling mill train, and mills including small-diameter work rolls which are driven by back-up rolls or intermediate rolls are disposed in middle and downstream stages of the hot strip finish rolling mill train, so that a strip can be rolled with strong draft and at a low speed, whereby a small-scale production of hot strips on the order of million tons annual yield can be achieved with a compact structure of equipment.

35 Claims, 27 Drawing Sheets

HOT STEEL PLATE ROLLING MILL SYSTEM AND ROLLING METHOD

BACKGROUND OF THE INVENTION

1. Field of the Invention

The present invention relates to a hot strip rolling mill system and rolling method by which small-scale production of hot strips can be realized with a compact structure of equipment.

2. Description of the Prior Art

As described in "Recent Hot Strip Manufacture Techniques in Japan", (published by Japan Steel Association, Aug. 10, 1987), p. 176 and pp. 6–10, for example, a typical hot steel plate rolling mill system (hereinafter referred to as "hot strip mill") is large-scaled such that a slab of 200 t is rolled by one or a plurality of rough rolling mills into a bar with a thickness of 20 to 40 mm, which bar is then rolled by tandem finish rolling mills comprised of 6 to 7 stands. Such a hot strip mill provides a yield of 3 to 4 million tons/year and is adapted for mass production. A 4-high mill of work roll driving type is employed as each of the rough rolling mills, and a 4-high or 6-high mill of work roll driving type is employed as each of the finish rolling mills.

Although a steel plate (hereinafter referred to as a "slab") fed to the rough rolling mill is generally of about 200 mm thick, there also is seen a slab of about 50 mm thick due to recent development of a thin slab continuous casting method. In the latter case, rough rolling mills become unnecessary and the hot strip mill is constituted solely by a group of finish rolling mills.

On the other hand, known as being of small-scale production type is the so-called Steckel mill comprising one reversible rough mill and a reversible mill provided with furnace coilers upstream and downstream thereof, as described, for example, in "Hitachi Review Vol 70, No. 6", (Jun. 25, 1988), pp. 67–72. The Steckel mill accompanies a disadvantage that holding the strip temperature and removing surface scale are difficult to achieve at the same time, but it has been widely used for rolling those strips such as stainless steel plates which are less likely to produce scale.

When the Steckel mill is applied to plain steel strip or the like, strip surface scale produced in the coiler furnaces must be removed by descaling jet water, which results in a problem of lowering the strip temperature.

Since product quality has to be sacrificed as mentioned above, applications of products are limited and examples of their use are small in all the wide world.

The current typical hot strip mill is of mass production type providing a yield of 3 to 6 million tons per year. Hitherto, there has naturally existed a demand for reducing the production scale and also reducing the equipment size correspondingly. Recent generation of iron scraps in a great deal of amount has put importance on recycling of those scraps, and such a concept that small-scale hot strip mills should be dispersedly installed for conveniently collecting the scraps rather than centralizing large-scale hot strip mills has prevailed in the world. Such a small-scale hot strip mill is simply called "mini hot". Thus, needs for optimum mini hots have become more stronger. Although the thin slab continuous casting method which has been focused on recently is intended for a mini hot by eliminating or lessening rough rolling, a group of finish rolling mills is still employed as it is conventionally.

SUMMARY OF THE INVENTION

The present invention is to innovate such a group of finish rolling mills and realize a genuine hot mill by adopting design which is beyond the common knowledge in the art. An annual yield required for a mini hot is generally on the order of one million tons, and this level of annual yield can be sufficiently realized at a rolling speed of about 240 m/minute on the delivery side of a hot tandem. In a typical hot strip mill, the maximum finish rolling speed is in the range of from 700 to 1600 m/minute, the number of stands is so many, and very large motor power is required. Low-speed rolling is preferable for a mini hot, but there have been technical problems in realization of such low-speed rolling.

The present invention is to solve the above-mentioned technical problems, and its object is to provide a hot strip rolling mill system and rolling method by which small-scale production of hot strips can be realized with a compact structure of equipment.

To achieve the above object, the present invention provides a hot rolling mill system comprising a rough rolling mill and a finish rolling mill train for rolling a hot material by the mills, wherein a mill including large-diameter work rolls which are directly driven is disposed in an upstream stage of the hot finish rolling mill train, and a mill including small-diameter work rolls which are indirectly driven by back-up rolls or intermediate rolls is disposed in at least a downstream stage of the hot finish rolling mill train.

Alternatively, according to the present invention, a mill including large-diameter work rolls which are indirectly driven by back-up rolls or intermediate rolls is disposed in an upstream stage of the hot finish rolling mill train, and a mill including small-diameter work rolls which are indirectly driven by back-up rolls or intermediate rolls is disposed in at least a downstream stage of the hot finish rolling mill train.

Alternatively, according to the present invention, a mill including small-diameter work rolls which are indirectly driven by back-up rolls or intermediate rolls is disposed in the hot finish rolling mill train, and the mill disposed in the upstream stage of the hot finish rolling mill train is so constructed as to thin a leading end portion of the hot material.

Alternatively, according to the present invention, a mill including small-diameter work rolls which are indirectly driven by back-up rolls or intermediate rolls is disposed in the hot finish rolling mill train, and an end thinning device for thinning a leading end portion of the hot material is disposed on the entry side of the hot finish rolling mill train.

Alternatively, according to the present invention, a 2-high mill including large-diameter work rolls which are directly driven is disposed in an upstream stage of the hot finish rolling mill train, the 2-high mill being able to change a roll-to-roll gap by making upper and lower work rolls crossed with respect to each other, and a mill including small-diameter work rolls which are indirectly driven by back-up rolls or intermediate rolls is disposed in at least a downstream stage of the hot finish rolling mill train.

Further, according to the present invention, a coiler for reeling and unreeling a bar rolled by the rough rolling mill is provided on the entry side of the hot finish rolling mill train, or a mechanical descaling method is employed as descaling, or an edge heater or a bar heater is provided between a reeling/unreeling device and a descaling device, or a chock chattering suppressing device is provided on each of the mills constituting the finish rolling mill train.

Also, to achieve the above object, the present invention provides a rolling method using a hot rolling mill system comprising a rough rolling mill and a finish rolling mill train for rolling a hot material by the mills, wherein the rolling is carried out by the hot finish rolling mill train with a strong draft and at a low speed.

Alternatively, according to the present invention, a leading end portion of the hot material is thinned prior to start of the rolling by the hot finish rolling mill train, and the hot material is then rolled by the hot finish rolling mill train with a strong draft and at a low speed.

Alternatively, the present invention provides a rolling method using a hot rolling mill system comprising a rough rolling mill and a finish rolling mill train for rolling a hot material by the mills, wherein mills constituting the hot finish rolling mill train each include small-diameter work rolls which are indirectly driven by back-up rolls or intermediate rolls, and when the hot material is rolled by the hot finish rolling mill train, a leading end portion of the material is thinned by the mill disposed in an upstream stage of the hot finish rolling mill train, and the material is then rolled again by the hot finish rolling mill train with a strong draft and at a low speed.

The steps of thinning the leading end portion of the hot material by the mill disposed in the upstream stage of the hot finish rolling mill train comprises opening a roll gap in the mill disposed in the upstream stage of the hot finish rolling mill train to such an extent as to be larger than the thickness of the material, passing the material through roll biting portions, stopping the material so as not to be bitten into the subsequent mill, and withdrawing the material to the entry side of the hot finish rolling mill train while the roll gap is closed or a certain amount of draft is applied, thereby thinning the leading end portion of the hot material.

Further, when the material is withdrawn to the entry side of the hot finish rolling mill train, an offset of the work rolls of the finish rolling mill is changed over to the entry side.

In order to realize a hot rolling mill system suitable for producing hot strips at an annual yield of about one million tons which is most keenly demanded at present, finish rolling is required to carry out a low-speed rolling.

When a finish rolling is carried out as low-speed rolling, finish temperatures of strips are lowered. Therefore, the finish rolling is performed with a strong draft and the number of stands of the finish rolling is reduced so as to prevent a lowering of the finish temperature. For achieving the strong draft, the diameters of work rolls are decreased. Corresponding to the decrease in the work roll diameter, the work rolls are indirectly driven by back-up rolls or intermediate rolls.

In other words, according to the present invention, a mill including small-diameter work rolls which are indirectly driven by back-up rolls or intermediate rolls is disposed in a train of finish rolling mills of a hot rolling mill system. With such an arrangement, it is possible to achieve a strong draft by the small-size mill, perform a rolling with a reduced number of stands and at a low speed, and further maintain finish temperatures of the strips at a desired temperature.

To ensure a strip biting ability of the mill in the upstream stage of the hot finish rolling mill train, in the present invention, a mill including large-diameter work rolls which are directly driven is disposed in the upstream stage of the hot finish rolling mill train, or a mill including small-diameter work rolls which are indirectly driven by back-up rolls or intermediate rolls is disposed in the upstream stage of the hot finish rolling mill train. Alternatively, the mill including small-diameter work rolls and disposed in the upstream stage of the hot finish rolling mill train is a mill which is so constructed as to be able to thin a leading end portion of the strip. Alternatively, a device for thinning the leading end portion of a hot material is disposed on the entry side of the hot finishing rolling mill train. Further alternatively, a 2-high mill including large-diameter work rolls which are directly driven is disposed in the upstream stage of the hot finish rolling mill train, and the upper and lower work rolls of that mill are crossed each other to enable change in the roll-to-roll gap.

In the case where a mill including small-diameter work rolls is disposed in the upstream stage of the hot finish rolling mill train, it becomes possible that the leading end portion of the hot material is thinned by the mill disposed in the upstream stage of the hot finish rolling mill train, and the material is thereafter rolled again by the hot finish rolling mill train with a strong draft and at a low speed.

When the finish rolling is carried out at a low speed, the hot material is left on the entry side of the hot finish rolling mill train under a condition held in contact with the atmosphere for a long time until it is brought into the finish rolling. This raises a fear of a temperature drop of the hot material and increase in the amount of scale produced.

To prevent such problem, in the present invention, a coiler for reeling and unreeling a bar rolled by the rough rolling mill is provided on the entry side of the hot finish rolling mill train. By so reeling up the bar into a coil, the surface area contacting the atmosphere can be reduced so that the amount of heat radiation and hence the amount of scale produced can be suppressed. Additionally, the coiler is provided with a cover for preventing heat radiation and thus given a structure capable of maximally exhibiting the advantage of the coiler.

On the other hand, if descaling is excessively performed with too much attention paid to the scale, the temperature of the hot material would be so lowered as to cause a fear that the strip could not eventually be maintained at a required temperature.

Rather than the conventional descaling method using water jets, the present invention employs mechanical descaling in which a brush roll is used or bending is utilized to cause cracks in scale to make the descaling performed at a reduced temperature drop. Of course, such mechanical descaling may be combined with the conventional descaling using water jets, so that contribution of water jets is alleviated to suppress a temperature drop of the hot material. In addition, a disk type grinder using CBN grinding grains, which has recently been employed in online grinders, may be disposed as a descaling means.

Further, the temperature at the edges of a hot material is apt to be lower than that in its central portion on the order of 30° to 40° C. Also, when a bar rolled by a rough rolling mill is reeled up into a coil, the temperature at the outermost layer of the coil is lower than that in its inner side on the order of 30° to 40° C.

In the present invention, an edge heater or a bar heater is provided between the reeling/unreeling device and the descaler to keep the hot material in a uniform temperature condition.

In addition, restraining the rolling direction of rolls is most effective in ensuring proper passage of the strip through a mill. Between a roll chock for supporting an associated roll and a housing for supporting the roll chock, a gap ranging from 0.8 to 1.5 mm has been conventionally left to avoid a problem that the roll chock be so expanded due to thermal expansion as to disable taking-out of the roll chock from the housing when the rolls are rearranged or replaced after a rolling. With the presence of such a gap, however, the rolls are caused to skew when a strip is bitten into or leaves from between the rolls. This gives rise to wedge rolling and/or produces a zigzag motion or drawing of the strip, whereby an availability factor is reduced as an inevitable result of shutdown of the mill or rearrangement or replacement of the rolls.

In the present invention, a chock chattering suppressing device for holding the associated roll from moving horizontally is provided to eliminate the gap between the chock and the housing. Accordingly, movement of the roll in the rolling direction is prevented to maintain such a roll gap as providing the strip with symmetrical crown.

The above and other objects, features and advantages of the present invention will become more apparent from the following description of preferred embodiments of the inveniton with reference to the accompanying drawings.

DESCRIPTION OF THE PREFERRED EMBODIMENTS

In the following, prior to describing embodiments of the present invention, a basic concept of the invention will be explained.

The present invention is based on an idea of using small-diameter work rolls in a train of finish rolling mills of a hot rolling mill system to thereby enable rolling to be carried out with a strong draft and at a low speed.

To concretely show the above matter, various characteristics were determined through theoretical calculations under conditions below.

Strip thickness on the finish entry side; 20 mm,

Strip width; 1300 mm,

Finish thickness; 2.0 mm,

Rolling speed; 240 m/minute

Strip temperature just before entrance of finish mill; 920° C. (after descaling)

Diameter of work roll; 300 to 800 mm

The calculations were made by assuming the number of finish mill stands to be 2, 3 and 5.

Figure 13:
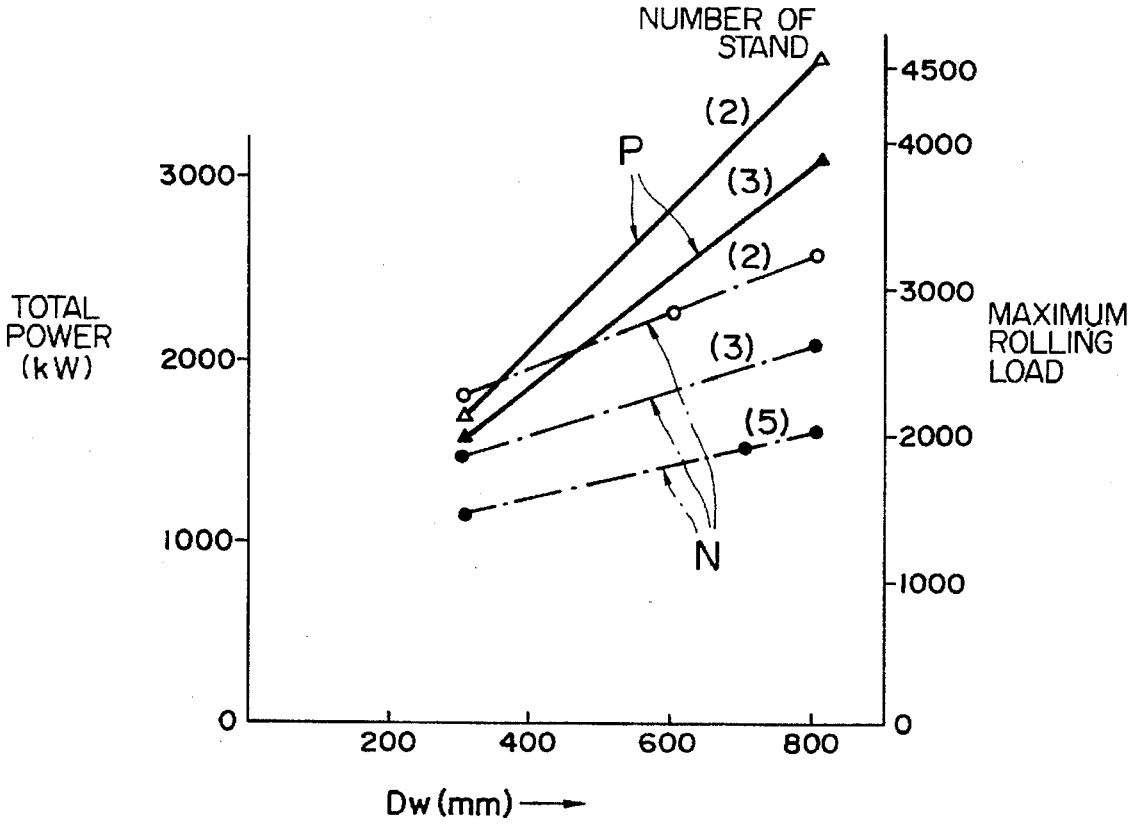
FIG. 13 is a characteristic graph showing the relationship between a work roll diameter and rolling characteristics.

Results of the calculations are shown in FIG. 13.

Note that a reduction rate $\gamma$ of each stand was set as shown in Table 1 below depending on the number of stands of a tandem mill.

TABLE 1

| Number of stands | F1 | F2 | F3 | F4 | F5 |
|---|---|---|---|---|---|
| 2 | 70 | 66.7 | / | / | / |
| 3 | 60 | 55 | 44.4 | / | / |
| 5 | 45 | 41 | 38.5 | 35 | 23.1 |

In FIG. 13, the horizontal axis represents a work roll diameter $D_W$ and the vertical axis represents a total rolling power N (KW) and a maximum rolling load P in the stands. Additionally, a value in ( ) indicates the number of stands.

It is seen that the rolling load and the total power are steeply reduced as the work roll diameter becomes smaller and as the number of stands is increased.

Figure 14:
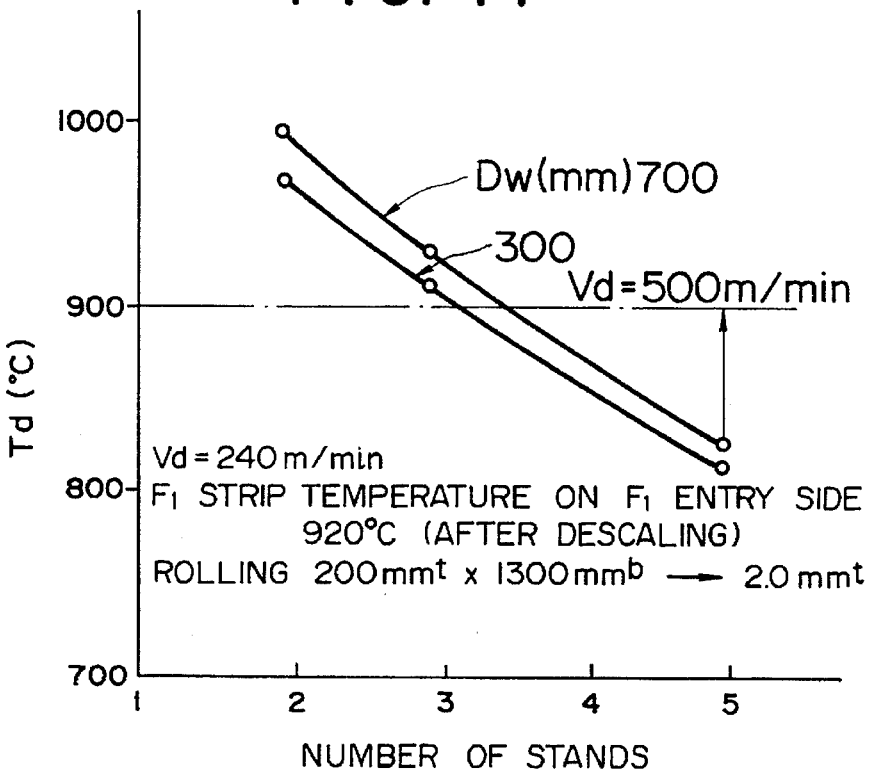
FIG. 14 is a characteristic graph showing the relationship between the number of stands and a finish temperature of strips.
Figure 15:
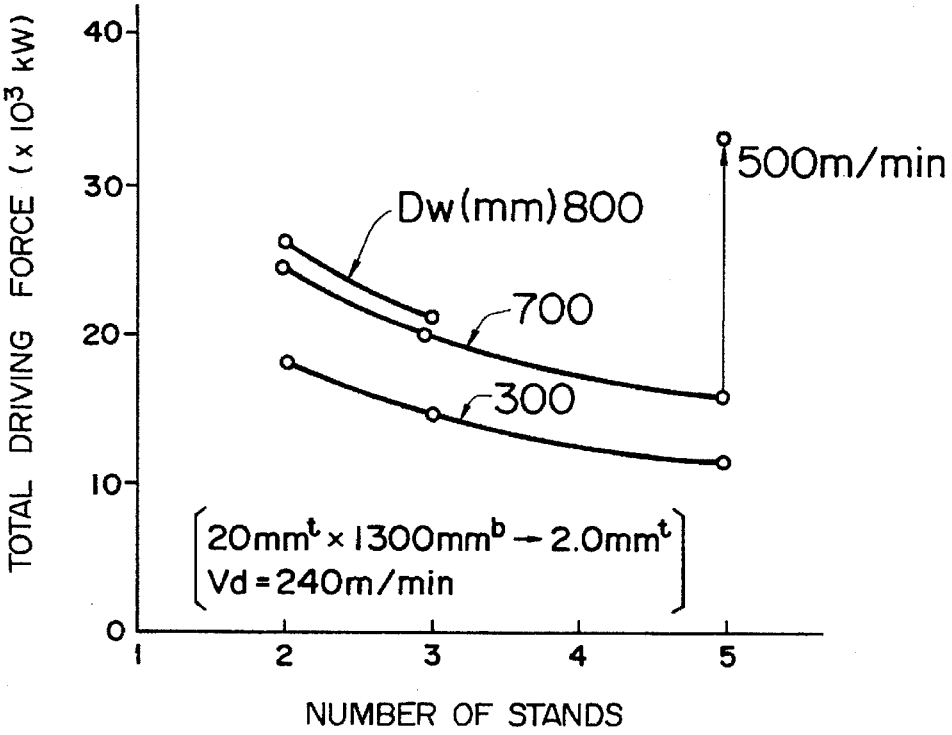
FIG. 15 is a characteristic graph showing the relationship between the number of stands and a total driving power.

FIG. 14 shows the relationship between the number of stands and the finish temperature $T_d$ of strips. As seen, with increase in the number of stands, $T_d$ is quickly dropped and becomes much lower than 900° C. which is needed usually. It is therefore necessary to increase an entry side temperature or a rolling speed. Because the former causes an increase in heating energy, the problem must be overcome by increasing the rolling speed. To meet such a requirement, a rolling speed $V_d$ must be increased to 500 m/minute as shown in FIG. 14. Accordingly, a driving power is required to be doubled and hence the installation cost is unduly raised.

On the other hand, if it is attempted to reduce the number of stands to 3 by a strong draft on an assumption that work rolls are driven as with the prior art, a large-size rolling mill with the work roll diameter of about 800 mm and the rolling load of 4000 tons·f would be required and the driving power would be increased 40% or more, thereby remarkably increasing the electric power elementary unit and affecting the production cost.

There is only one way of solving the above problem and this is to reduce the work roll diameter to about ½ of the conventional diameter. For example, comparing electric power elementary units between a mill which has 5 stands and uses work rolls each having a diameter of 800 mm and a mill which has 3 stands and uses work rolls each having a diameter of 400 mm, both values are almost equal to each other. In the mill having 5 stands, however, the finish temperature $T_d$ of strips is too lowered. In order to maintain the strip temperature, therefore, the rolling speed must be increased to 750 m/minute which requires a larger equipment power. If the work roll diameter is made smaller than 400 mm, the electric power elementary unit is further reduced.

Figure 16:
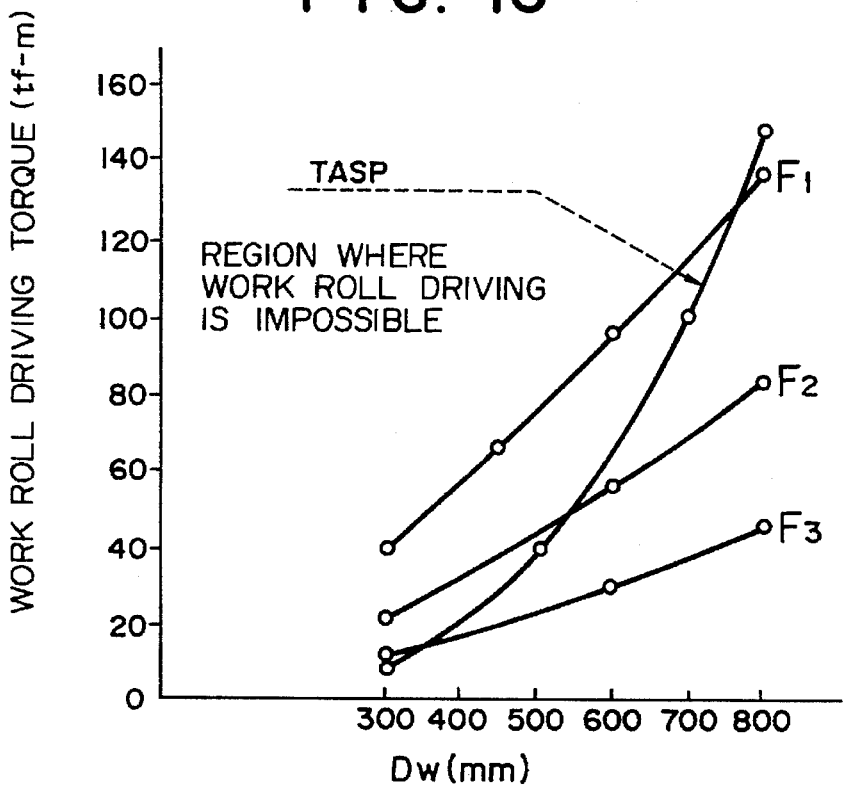
FIG. 16 is a characteristic graph showing the relationship between a required torque and a spindle allowable torque.

Meanwhile, in the mill using small-diameter work rolls, the work roll driving cannot be carried out from the standpoint of strength. FIG. 16 shows work roll diameters at which the work roll driving can be carried out in the case of 3 stands. In FIG. 16, "Tasp" indicates the limit of the region where the work roll driving can be done.

The limits in the work roll diameter are about 780 mm for No. 1 stand $F_1$ in a train of finish rolling mills, about 570 mm for $F_2$, and about 380 mm for $F_3$. With this system, however, preparing three kinds of rolls for the finish rolling mills is inconvenient, back-up rolls are also eventually selected to have a large diameter determined for $F_1$, and hence an equipment cost cannot be cut down satisfactorily. The system approaches an ideal one if work rolls each having a smaller diameter on the order of 300 mm can be used for all the stands. To this end, it is required to cease driving of work rolls and drive intermediate rolls or back-up rolls. The latter driving method has been carried out in many cases for cold rolling, but has not been practiced for hot rolling except special cases. This is because a problem in biting strips arises in an indirect driving system for hot rolling in which intermediate rolls or back-up rolls are driven.

The aforesaid special cases are a 3-high mill and a planetary mill. In the 3-high mill, one of two work rolls is directly driven and the other is indirectly driven by a back-up roll. The work rolls are each of a relatively large diameter. Since the back-up roll becomes a work roll in subsequent rolling, it cannot be so large as a back-up roll of a 4-high mill and, therefore, the draft is light. Thus, such a 3-high mill is not regarded as an example in which each of work rolls has a small diameter and is effective to provide strong draft. In a planetary mill, twenty small-diameter work rolls, more or less, are arranged around a back-up roll and revolved about the same to carry out rolling. Since a reduction rate per work roll is very small, such a planetary mill cannot be referred to realize a mill in which strong draft is performed by one work roll. Rolling conditions for such an indirect driving system that work rolls are driven by intermediate rolls or back-up rolls are determined by the following two factors.

(1) Strip biting conditions $$\left.\begin{array}{ll} \text{Work roll driving} & \Delta h_g = \mu^2 R - P/K \\ \text{Indirect driving} & \Delta h_g = \mu_R^2 R - P/K \\ \text{(on assumption of } \mu_R < \mu) & \end{array}\right\} \quad \text{(Eq. 1)}$$

(2) Rolling implementing conditions after biting $$\left.\begin{array}{ll} \text{Work roll driving} & \Delta h_\gamma = 4\mu^2 R \\ \text{Indirect driving} & \Delta h_\gamma = 4\mu_R^2 R \end{array}\right\} \quad \text{(Eq. 2)}$$

In Equations 1 and 2, $\Delta h_g$ is the maximum reduction rate determined by limitations in biting, $\mu$ is the coefficient of friction between a strip and a work roll, $\mu_R$ is the coefficient of friction between a work roll and a roll held in contact with the work roll, P is a rolling load, K is the spring constant of the rolling mill, and R is a radius of the work roll. Also, $\Delta h\gamma$ is a reduction rate by which the strip can be rolled after it has been bitten by the rolls. From Equations 1 and 2, the following can be said.

(1) Both $\Delta h_g$ and $\Delta h_\gamma$ become larger as the radius of the work roll is increased.

For $\Delta h_g$, an increase in R makes the rolling load larger and also a subtractive value larger, but it is increased as a whole.

(2) $\Delta h\gamma$ is as large as at least 4 times of $\Delta h_g$. Accordingly, the reduction rate is restricted by the biting condition.

The value of $\mu$ is varied depending on the strip temperature, the roll surface condition, the roll hardness, the rolling speed, etc. and generally about 0.3.

The reason why large-size work rolls have been used with the work roll driving type in the past is as follows.

(1) Work rolls must be large in diameter for ensuring a biting ability.

(2) In the case of indirect driving, mill performance is limited by the coefficient of roll-to-roll friction $\mu_R$, and a possibility of roll-to-roll slip has existed because characteristics of the coefficient of friction have not yet been clear. By employing large-diameter work rolls, however, it is possible to drive the work rolls and assure a biting ability.

Provided that one follows the above concept, an ideal mini hot cannot be realized in which a mill using small-diameter work rolls so as to obtain strong draft and low-speed rolling is disposed in a train of finish rolling mills of a hot rolling mill system, as pointed out above.

Hereinafter, preferred embodiments of the present invention will be described with reference to the drawings.

Figure 1:
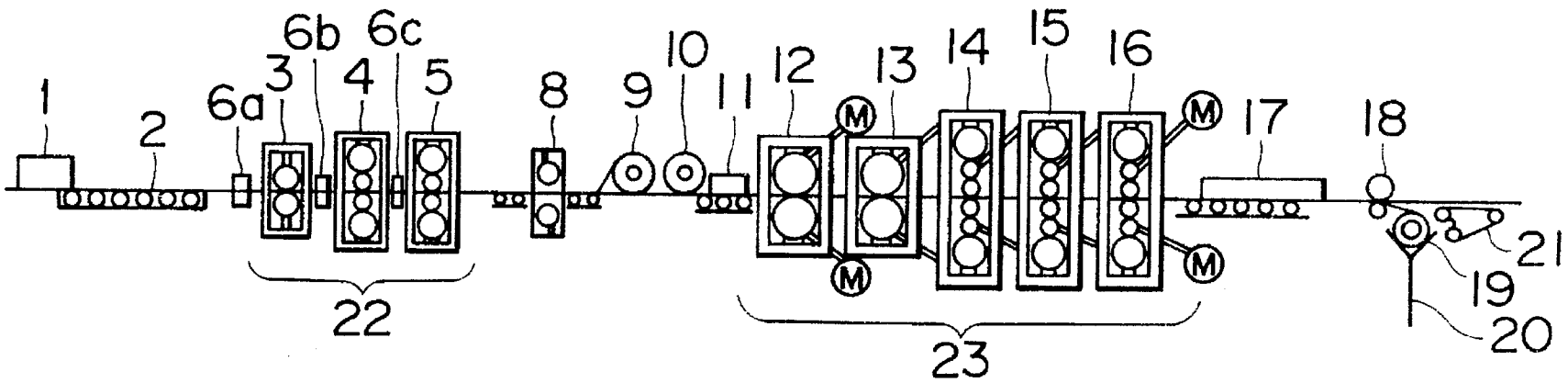
FIG. 1 is a schematic view of a hot rolling mill system showing a first embodiment of the present invention.

FIG. 1 is a schematic illustration of a hot rolling mill system showing a first embodiment of the present invention. A slab having a thickness of about 200 mm and delivered from a heating furnace 1 is conveyed by a table roller 2 and then rolled by a rough rolling mill train 22 comprised of rough rolling mills 3, 4, 5 while the slab is adjusted in width by edgers 6*a*, 6*b*, 6*c* and becomes a bar with a thickness of about 20 mm. The bar is cropped at its leading and trailing end portions by a flying shear 8 and thereafter reeled up in a coil box 9. The coiled bar is then reeled out from a coil unreeling position 10 and fed to a finish rolling mill train 23 after oxide scale deposited on the bar surfaces is stripped off by a descaling device 11.

For surely providing upstream mills with a biting ability, the finish rolling mill train 23 includes, in two upstream stages, mills 12, 13 including large-diameter work rolls which are directly driven.

While the two 2-high mills 12, 13 are disposed in the illustrated embodiment, each 2-high mill may be replaced with a 4-high mill including large-diameter work rolls which are directly driven. Further, the number of 2-high or 4-high mills disposed in upstream stages may be one.

In middle and downstream stages of the finish rolling mill train 23, there are disposed mills 14, 15, 16 each including small-diameter work rolls which are driven by back-up rolls or intermediate rolls. These mills 14, 15, 16 roll the bar with a strong draft and at a low speed.

In the case of a 4 ft. mill (i.e., a mill for rolling a strip of 4 feet width), each of the finish rolling mills is constituted by a 4-high or 6-high mill in which each work roll has a small diameter in the range of from about 300 to 400 mm and is driven by an intermediate roll.

The strip on which finish rolling has been completed is cooled by water in a cooling device 17, fed by pinch rolls 18 and then reeled up by a coiler 19 with the aid of a chain type belt trapper 21. After completion of the reeling, the coiled strip is carried out by a coil car 20.

Although the embodiment shown in FIG. 1 has been described as rolling the slab delivered from the heating furnace 1, the present invention is not limited thereto, but may be directly coupled with a continuous casting machine.

This equally applies to any of embodiments described below.

In the above description of this embodiment, diameters of work rolls used in the mills have been classified into large- and small-diameters. To explain it more specifically, the large-diameter work roll usually means one which has a diameter in the range of from 600 to 900 mm. In this embodiment, however, it means a roll which has a diameter not less than 450 mm (this equally applies to any of the embodiments described below).

Also, the small-diameter work roll usually means one which has such a diameter as to disable direct driving of the work roll, as explained before; e.g., one having a diameter of a value at which a ratio $D_W/B$ of the work roll diameter $D_W$ to the strip width B is about 0.3 or less. In this embodiment, it means one which has a diameter not more than 450 mm (this equally applies to any of the embodiments described below).

A hot rolling mill system of a second embodiment of the present invention will be described below with reference to FIG. 2. In this embodiment, a slab cast by a continuous casting machine 87 is directly connected to the hot rolling mill system.

Figure 2:
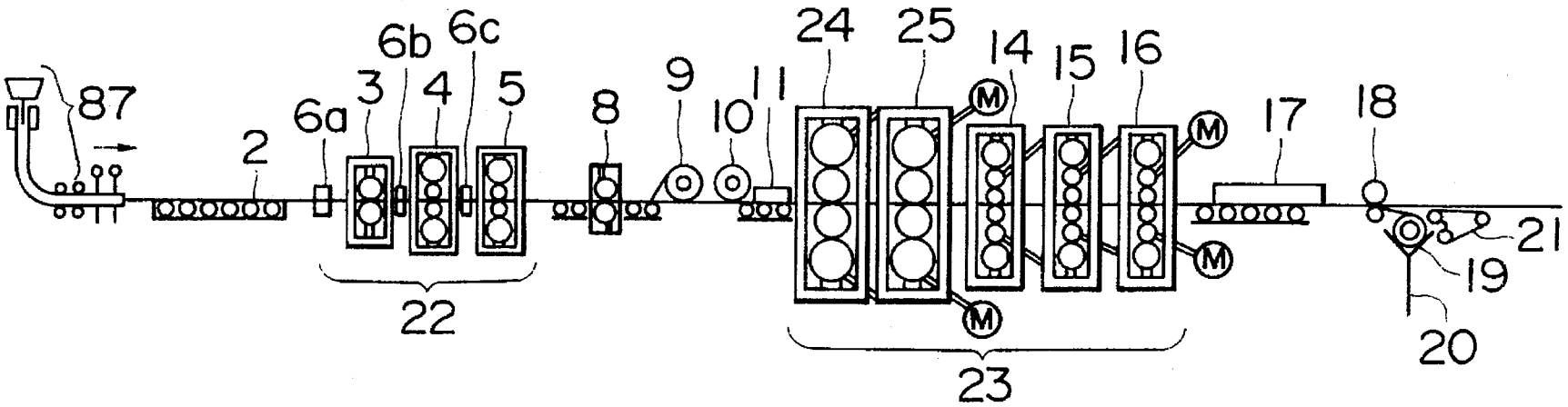
FIG. 2 is a schematic view of a hot rolling mill system showing a second embodiment of the present invention.

In FIG. 2, the upstream mills 12, 13 in the finish rolling mill train 23 of the hot rolling mill system described above with reference to FIG. 1 are replaced by mills 24, 25 each including large-diameter work rolls which are driven by back-up rolls or intermediate rolls. This arrangement is to also surely provide those upstream mills with a biting ability.

Figure 3:
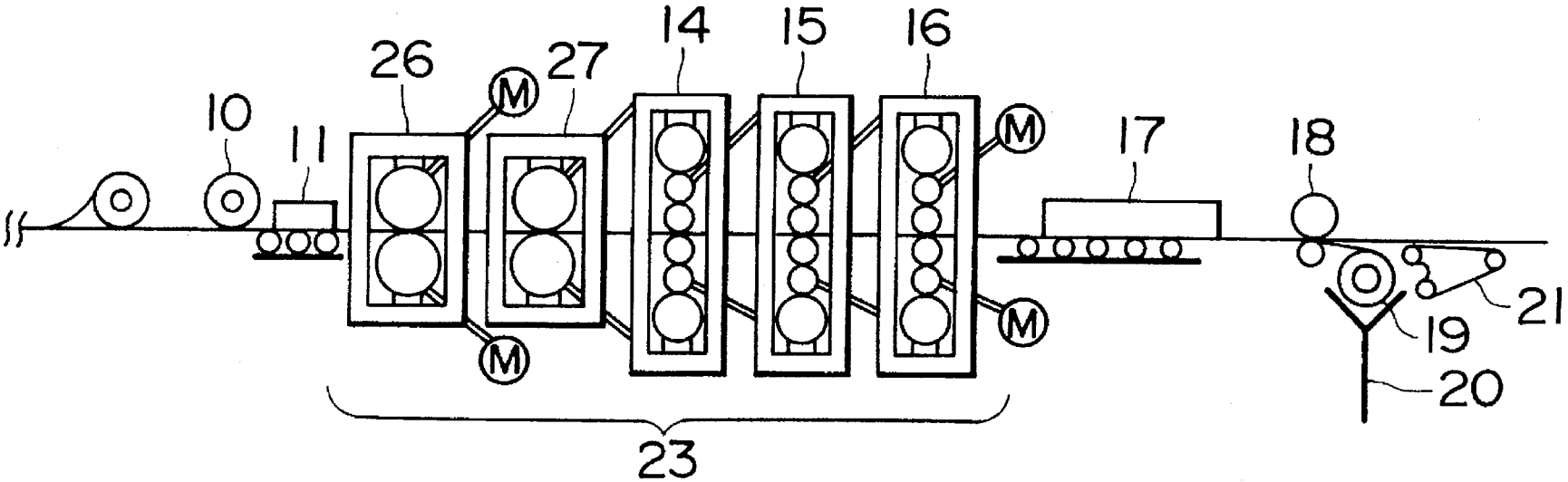
FIG. 3 is a schematic view of a hot rolling mill system showing a third embodiment of the present invention.

FIG. 3 shows a hot rolling mill system of a third embodiment of the present invention. The upstream mills 12, 13 in the finish rolling mill train 23 of the hot rolling mill system described above with reference to FIG. 1 are replaced by 2-high mills 26, 27 each including upper and lower large-diameter work rolls which are directly driven and also crossed with respect to each other.

In any of the above-described embodiments shown in FIGS. 1 to 3, the work rolls of the upstream mills in the finish rolling mill train 23 are selected to be large in diameter to enable self-biting as in the prior art. In the case where the strip thickness becomes smaller than aforesaid $\mu^2R$ in the mill at any subsequent stand, those stands downstream of the relevant stand are each constituted by a mill having small-diameter work rolls which are indirectly driven.

In order to enable even the small-diameter work rolls to meet the biting condition for the upstream mills in the finish rolling mill train, a value of $\mu_R$ will be confirmed by an experiment and how to enable small-diameter work rolls of indirect driving type to be employed will be described below.

Figure 17:
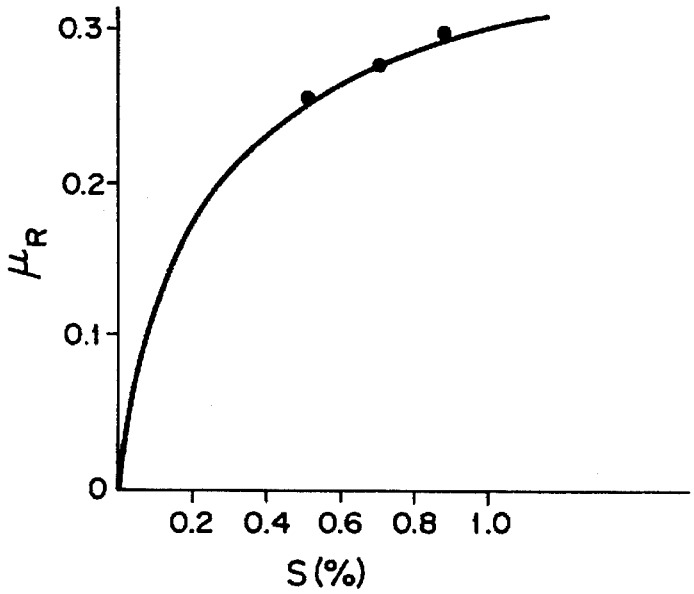
FIG. 17 is a characteristic graph showing the coefficient of roll-to-roll friction in the circumferential direction.

FIG. 17 shows experimental values of the coefficient of roll-to-roll friction $\mu_R$. In the experiment, only cooling water was supplied between the rolls. $\mu_R$ is increased at a greater roll-to-roll slippage S and reaches about 0.3 at S=1%. Here, S is defined by Equation 3 below.

$$S = \frac{V_D - V_F}{V_D} \times 100\% \qquad \text{(Eq. 3)}$$

In Equation 3, $V_D$ is a circumferential speed of a drive roll and $V_F$ is a circumferential speed of a driven roll, i.e., a work roll. The larger slippage S increases $\mu_R$, but an excessive value of the latter will cause wears in the rolls and a loss of energy. Therefore, if S is held at about 0.2% during the rolling and at about 0.4% at the time of biting, $\mu_R$ becomes about 0.17 during the rolling and about 0.22 at the time of biting.

On the above conditions, the following Equations 4 and 5 are derived from Equations 1 and 2.

$$\Delta h_g = 0.22^2 R - P/K \qquad \text{(Eq. 4)}$$

$$\Delta h_\gamma = 4 \times 0.17^2 R = 0.116R \qquad \text{(Eq. 5)}$$

By way of example, where the work roll diameter is 300 mm and the rolling schedule in Table 1 is employed with the tandem number set to 3, the following values are obtained for $F_1$ on condition of P =1800 tf and K=360tf/mm (estimated):

$$\Delta h_g = 0.22^2 \times 150 - 1800/360 = 7 - 5 = 2(\text{mm})$$

P is lowered in practice and, hence, the resulting value becomes larger than 2 mm $$\Delta h_\gamma = 0.116 \times 150 = 17(\text{mm})$$

In the above rolling schedule, $\Delta h = 20 \times 0.6 = 12(\text{mm})$ is required for $F_1$, meaning that $\Delta h_\gamma$ is sufficient, but $\Delta h_g$ is remarkably insufficient.

Accordingly, it is required to thin a leading end portion of the strip to such an extent as to be enough to enable biting before the strip is bitten into the finish rolling mill train.

In the rolling schedule of Table 1, for example, rolling loads for $F_1$ and $F_2$ are calculated to be 1800 tf and 1630 tf, respectively. It is then determined to what thickness $H_t$ a strip inlet thickness of 20 mm should be thinned. A strip outlet thickness h is obtained from the following Equation 6 on assumption that a roll gap is set to $g_0$.

From $h=g_0+P/K$, and $H_t-g_0=\mu^2_R$ $$H_t=g_0+\mu^2_R,\ g_0=h-P/K \quad \text{(Eq. 6)}$$

For the $F_1$ mill, $$g_0=8-1800/360=8-5=3$$

From $\mu^2_R=7$, $H_t=3+7=10$(mm) is given. Thus, the biting is made practicable by thinning the strip thickness from 20 mm to 10 mm.

Figure 18:
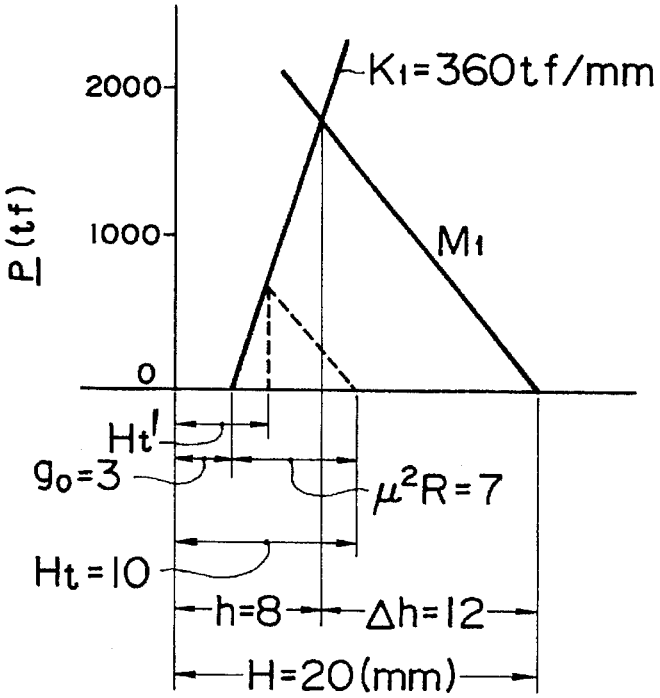
FIG. 18 is a graph showing biting characteristics of a No. 1 stand $F_1$ of in the finish rolling mill train.
Figure 19:
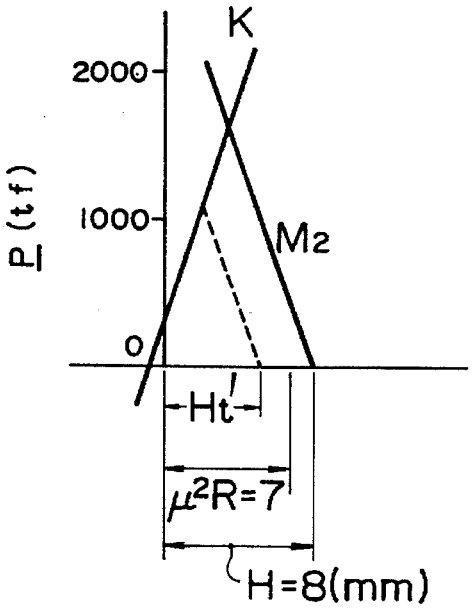
FIG. 19 is a graph showing biting characteristics of a No. 2 stand $F_2$ of in the finish rolling mill train.

The above condition is illustrated in FIG. 18. In the graph shown in FIG. 18, $M_1$ represents a plastic spring constant of the strip. If a length of the leading thinned portion $H_t$ is larger than a certain value, the leading end portion is reduced by the rolling to a thickness $H_t'$ smaller than h=8 mm, allowing the strip to be more easily bitten in the $F_2$ mill. This condition is illustrated in FIG. 19. Even though the bitting is unable at the leading end thickness of 8 mm, it is enabled at the smaller thickness $H_t'$.

A description will now be made of an embodiment in which the leading end portion of the strip to be bitten into the finish rolling mill train is thinned to such an extent as to be enough to enable the biting before entering the finish rolling mill train.

Figure 4:
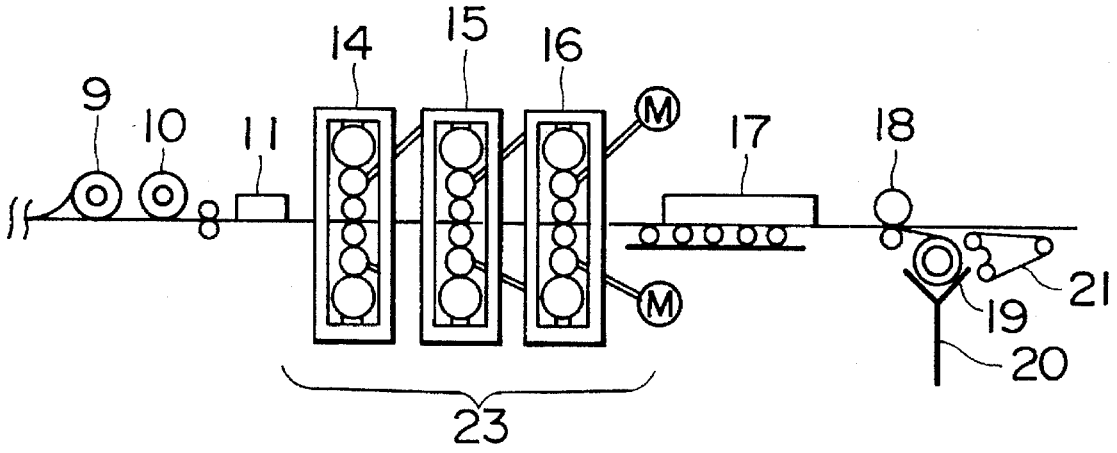
FIG. 4 is a schematic view of a hot rolling mill system showing a fourth embodiment of the present invention.

FIG. 4 is a schematic view of a hot rolling mill system showing a fourth embodiment of the present invention. In this embodiment, the finish rolling is carried out by thinning the leading end portion of the strip to such an extent as to be enough to enable the biting, by means of a mill constituting the finish rolling mill train.

Note that, in the embodiment shown in FIG. 4, the parts upstream of the coil box 9 are the same as those shown in FIG. 1 or FIG. 2.

As mills constituting the finish rolling mill train 23, there are disposed mills 14, 15, 16 each including small-diameter work rolls which are driven by back-up rolls or intermediate rolls.

The embodiment shown in FIG. 4 has, however, a problem that a strip biting ability is insufficient because the upstream mill 14 of the finish rolling mill train 23 is a mill including small-diameter work rolls which are driven by back-up rolls or intermediate rolls.

A practical method of ensuring a strip biting ability will be described with reference to FIG. 5.

FIGS. 5A to 5D are explanatory views for explaining a method of thinning a leading end portion of the strip.

Figure 5A:
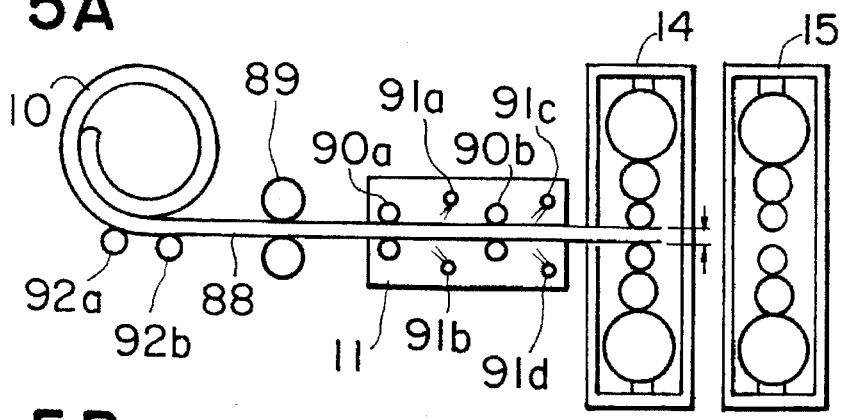
FIGS. 5A to 5D are explanatory view for showing a practical method of ensuring a strip biting ability of a mill including small-diameter work rolls.

A strip 88 reeled out from a coil unreeling position 10 of a coil box is fed by pinch rolls 89 to a descaling device 11 provided with water wiping rolls 90*a*, 90*b* and descaling headers 91*a* to 91*d*, and then to the finish rolling mill train after scale on the strip surfaces has been removed. At this time, as shown in FIG. 5A, a roll gap of the No. 1 mill 14 of those mills constituting the finish rolling mill train is opened to such an extent as to be larger than the thickness of the strip 88, and the strip 88 is stopped when its leading end has passed the biting portions of the work rolls and has reached an arbitrary position before the strip is bitten into the next stand 15.

Figure 5B:
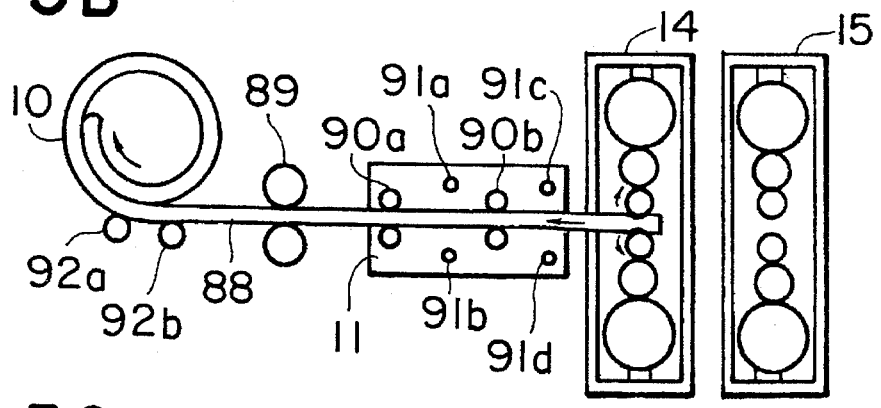

Next, as shown in FIG. 5(B), the strip 88 is returned to the entry side of the No. 1 mill 14 while the roll gap is closed or a constant reduction rate and gradual draft are combined, and the rolls of the No. 1 mill 14, the pinch rolls 89 and cradle rolls 92*a*, 92*b* of the coil box are reversed in rotation. On this occasion, the descaling device 11 is turned off to prevent a temperature drop of the strip. For taking balance with the driving tangential forces, the reverse rolling is carried out with the work rolls offset to the entry side.

Figure 5C:
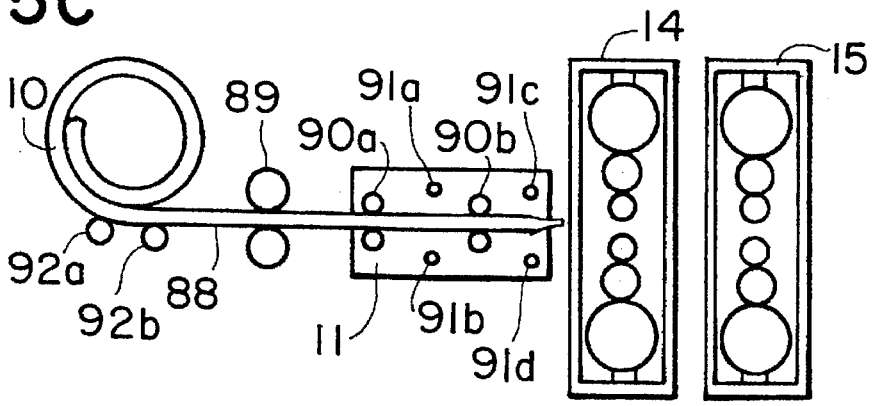

Then, as shown in FIG. 5C, the strip 88 is stopped at the time when its leading end has returned to the entry side of the No. 1 mill 14. The leading end portion of the strip is thereby thinned.

Figure 5D:
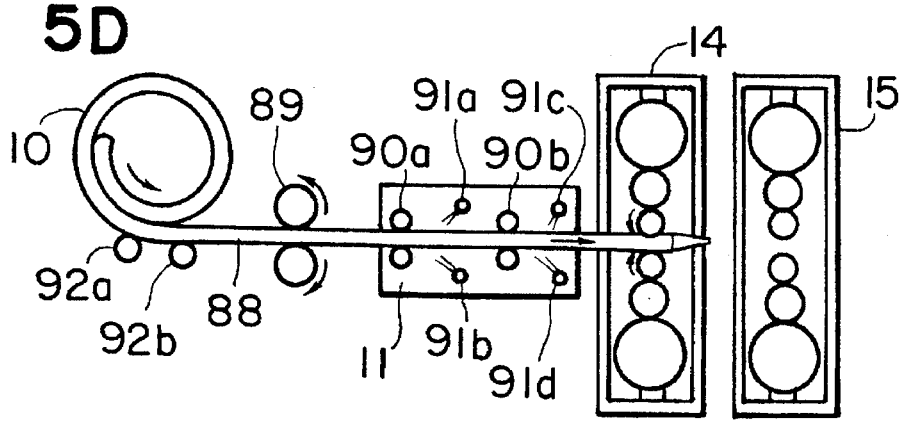

After that, as shown in FIG. 5D, the No. 1 mill 14 is operated to rotate forwardly again so that the strip 88 is fed into the No. 1 mill 14. At this time, since the leading end portion of the strip 88 has been thinned, the strip is bitten into the No. 1 mill 14 to enable normal rolling. This rolling is performed by restoring the offset of the work rolls back to the original delivery side position.

Additionally, in the operation subsequent to the step shown in FIG. 5D, the descaling device 11 is turned on again so as to remove scale on the strip surfaces. By adopting the above method, it is possible to cause a strip to be bitten into small-diameter work rolls without providing a new strip end thinning device, and hence to realize an inexpensive mini hot equipment.

Figure 6:
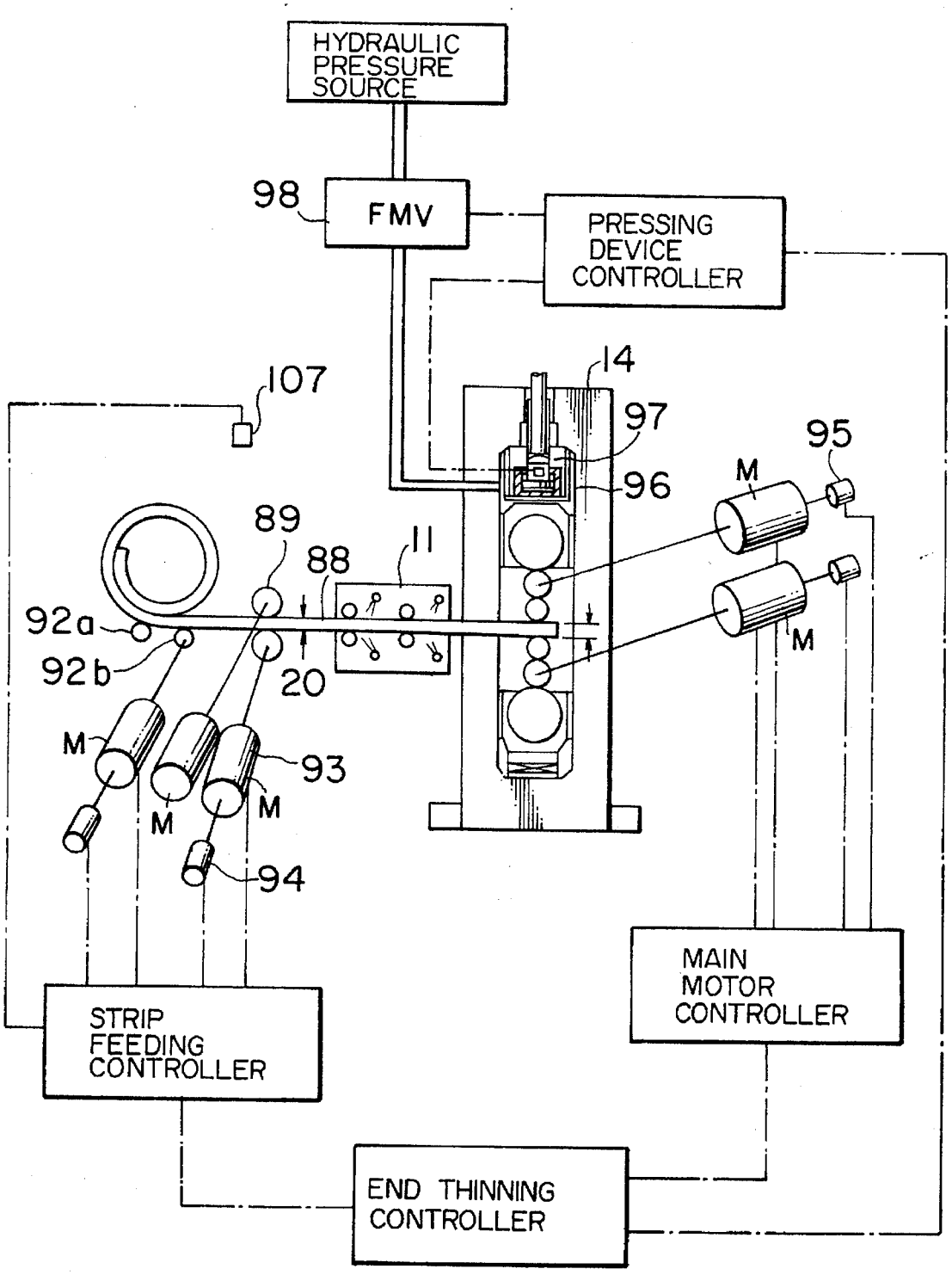
FIG. 6 is a schematic view of a finish rolling mill as No. 1 mill in a finish rolling mill train and a control block diagram for thinning the leading end portion of the strip.

FIG. 6 shows a control block diagram for thinning the leading end portion of a strip in the No. 1 mill constituting the finish rolling mill train shown in FIG. 5.

The strip 88 is fed by driving cradle rollers 92*a*, 92*b* and pinch rolls 89 which are disposed to reel out the strip from the coil box. The leading end position of the strip 88 is detected by a hot metal sensor 107 and, thereafter, determined on the basis of the number of rotation of the pinch roll 89 counted by a pulse generator (PLG) 94 attached to a drive motor 93 for the pinch roller 89. Based on these information data, the leading end position of the strip 88 is controlled by a strip feeding controller.

On the other hand, driving of the rolls of the No. 1 mill 14 is controlled by a main motor controller based on currents and voltages of main motors and rotation signals from PLGs 95 attached to axial ends of the main motors.

Further, a draft position of the roll is detected by a magnet scale 97 provided on a pressing cylinder 96 and is controlled by a servo valve 98 in accordance with commands from a pressing device controller.

An end thinning controller functions to supervise the above control operations for sequentially thinning the leading end portion of the strip shown in FIG. 5 based on the information data obtained.

FIGS. 7A to 7D are explanatory views for explaining a method of thinning the leading end portion of the strip.

Figure 7A:
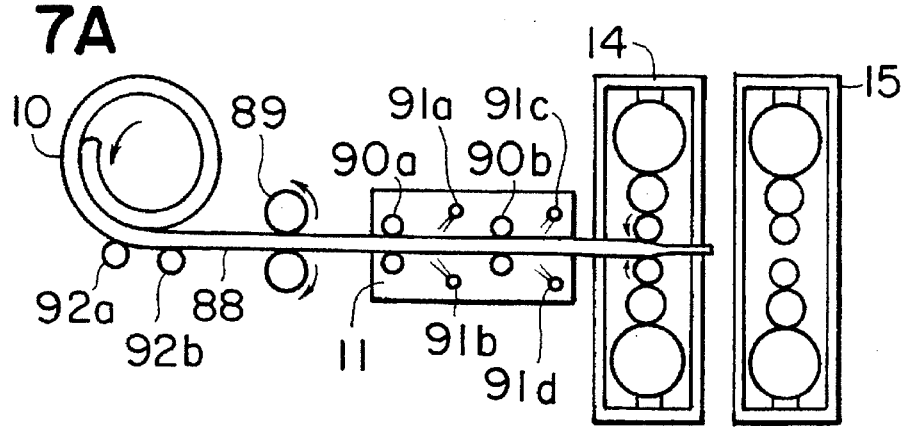
FIGS. 7A to 7D are explanatory views for showing another practical method of ensuring a strip biting ability in a mill including small-diameter work rolls.
Figure 7B:
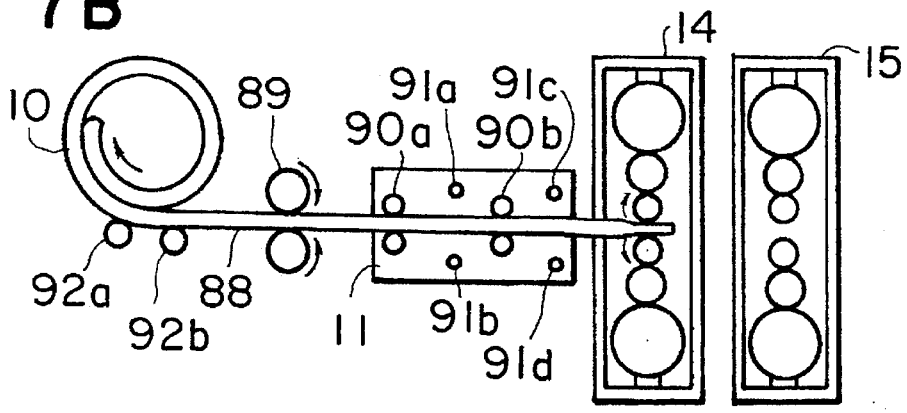
Figure 7C:
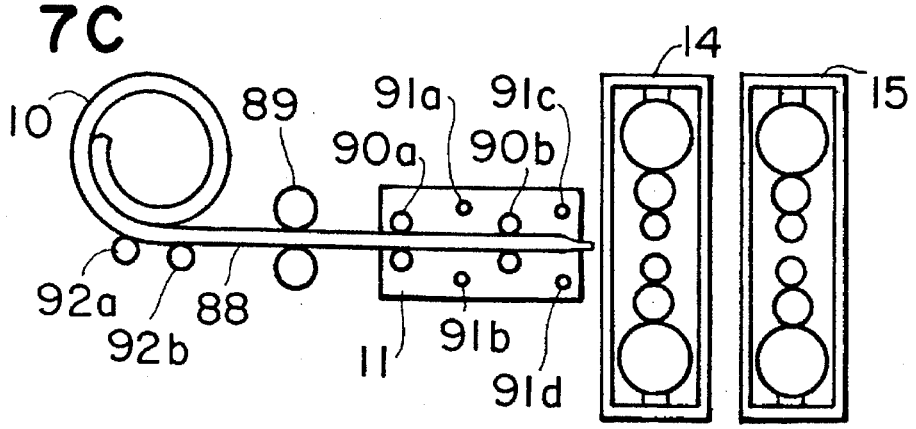

First, in order to carry out the end thinning of the strip 88 by a No. 1 mill 14, the strip is fed to pass through the mill while being thinned at its leading end portion by the No. 1 mill 14 at an appropriate reduction rate and stopped when its leading end has reached an arbitrary position before the leading end is bitten into the next stand 15, as shown in FIG. 7A. Next, as shown in FIG. 7B, the strip is returned to the entry side of the No. 1 mill 14, so that the leading end portion of the strip is thinned again. At this time, the strip 88 is returned to the entry side of the No. 1 mill 14 while the rolls of the No. 1 mill 14, the pinch rolls 89 and the cradle rolls 92*a*, 92*b* of the coil box are reversed in rotation. Then, as shown in FIG. 7C, the strip 88 is stopped at the time when its leading end has returned to the entry side of the No. 1 mill 14. The leading end portion of the strip is thereby thinned.

Figure 7D:
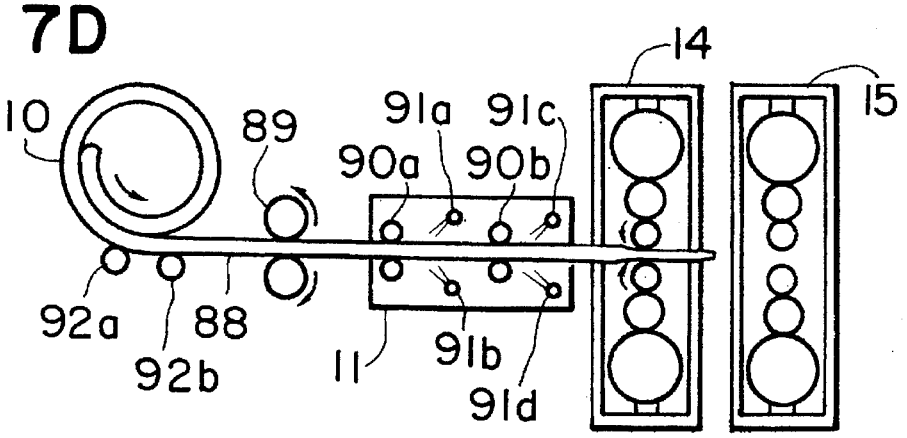

After that, as shown in FIG. 7D, the No. 1 mill 14 is operated to rotate forwardly again so that the strip 88 is fed to the No. 1 mill 14. At this time, since the leading end portion of the strip 88 has been thinned, the strip is bitten into the No. 1 mill 14 to enable normal rolling to be carried out.

Note that the operation of the descaling device 11 and the change in offset of the work rolls are performed in a like manner as described above with reference to FIGS. 5A–5D.

Figure 8:
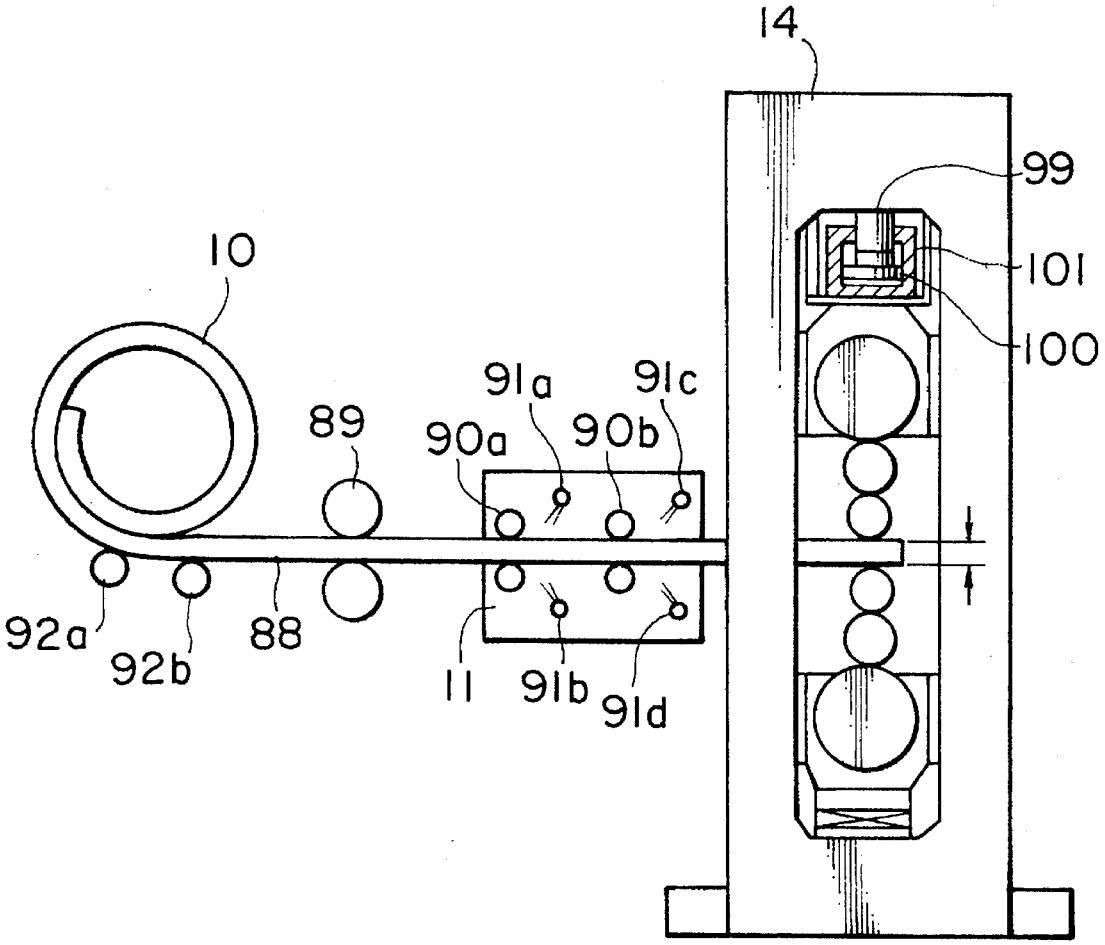
FIG. 8 is a schematic view of a mill for thinning a leading end portion of the strip.

FIG. 8 shows a general structure of a mill suitable for the gap adjustment and draft which have been described with reference to FIGS. 5 and 7 and are to be carried out in the No. 1 mill 14 for thinning the leading end portion of a strip.

While a hydraulic cylinder for thinning the leading end portion of the strip may be separate from a draft device for normal rolling, a common type hydraulic cylinder comprising a draft ram 99, a draft cylinder 100 and a cylinder support 101, as shown in FIG. 8, can also be used for making the structure simpler and the equipment cost cheaper. This is for the purpose of minimizing the operating time required for a series of end thinning steps and, thus, the temperature drop. In this case, it is necessary to employ a servo valve having a large capacity not less than 300 l/minute, for example, for ensuring a high operating speed of the hydraulic cylinder.

Figure 9:
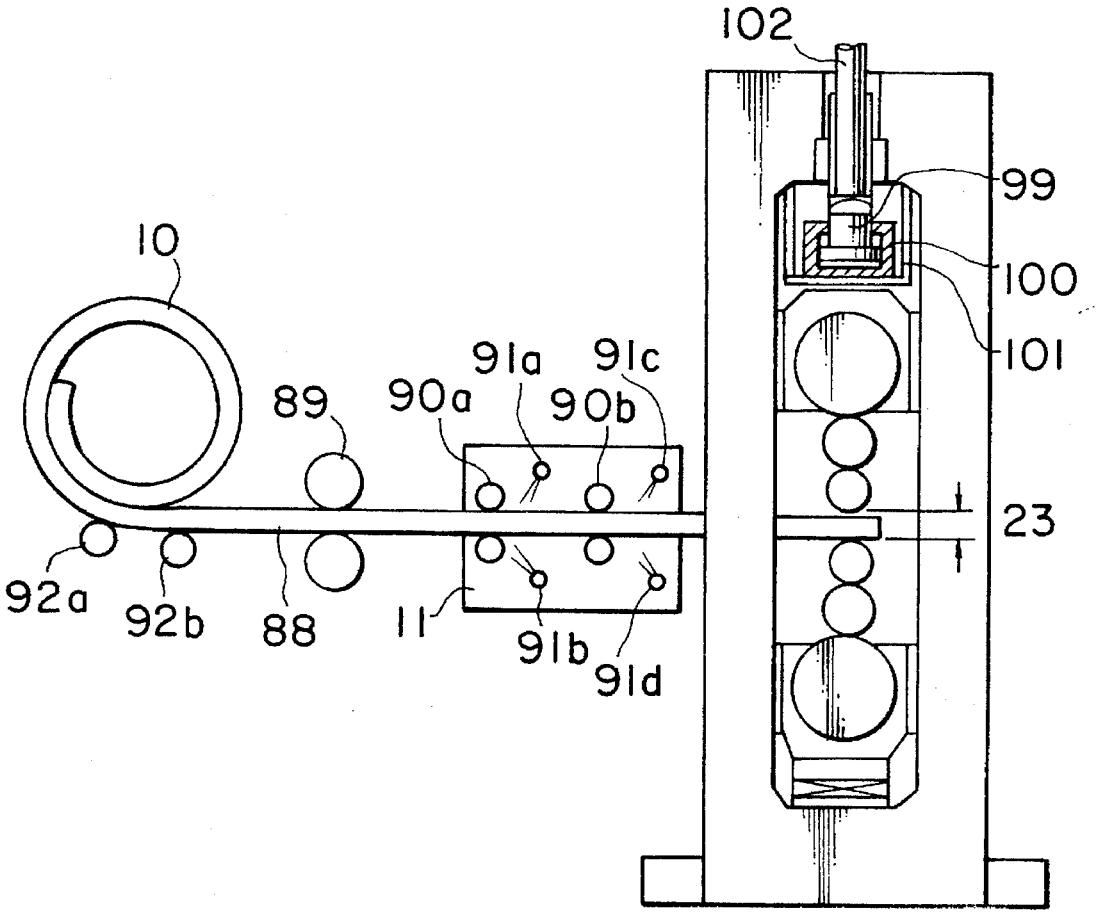
FIG. 9 is a schematic view of a mill for thinning a leading end portion of the strip.

FIG. 9 shows a construction of a mill in which a draft screw 102 is combined with the hydraulic cylinder shown in FIG. 8.

In this case, the draft in normal rolling is performed by using the draft screw 102, and the leading end portion of the strip is thinned by using the hydraulic cylinder. With the combined arrangement, the operating time can be shortened.

An embodiment in which finish rolling is carried out after thinning the leading end portion of the strip to such an extent as to enable the biting before the strip is bitten into the finish rolling mill train, will be described below with reference to FIG. 10.

Figure 10:
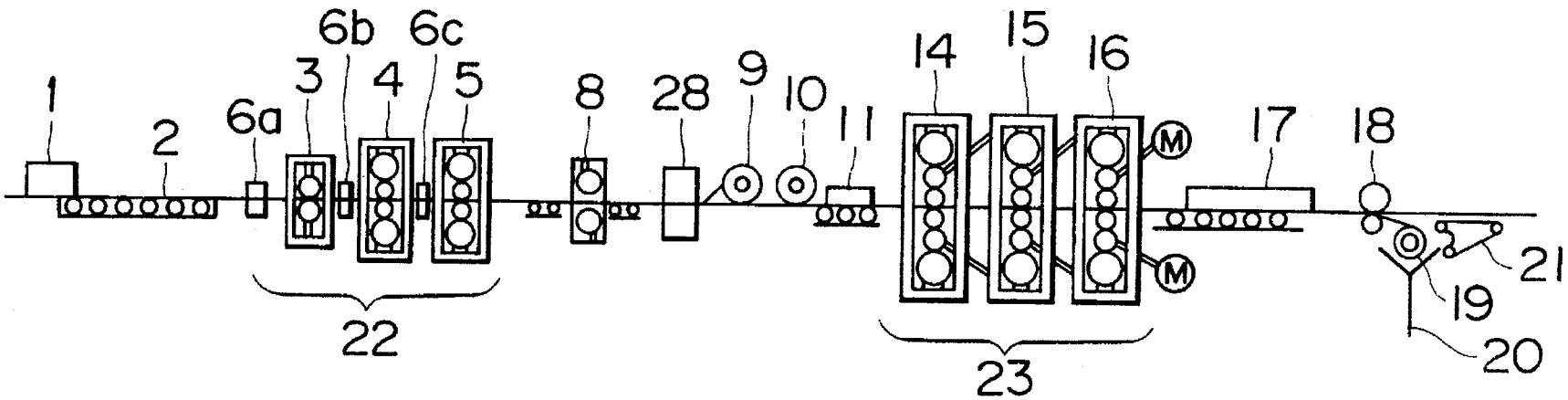
FIG. 10 is a schematic view of a hot rolling mill system showing a fifth embodiment of the present invention.

FIG. 10 is a schematic view of a hot rolling mill system showing a fifth embodiment of the present invention. The embodiment corresponds to the hot rolling mill system described with reference to FIG. 1 in which a thinning device 28 for thinning the leading end portion of the strip is disposed upstream of the coil box 9. The provision of the thinning device 28 eliminates the need for the finish rolling mills 12, 13 shown in FIG. 1.

The thinning device 28 is constructed to press the strip by using rolls not rotating. This is because the rolls can be repeatedly used by changing a set angle and also can be easily ground when the pressing surfaces become roughened.

Figure 11:
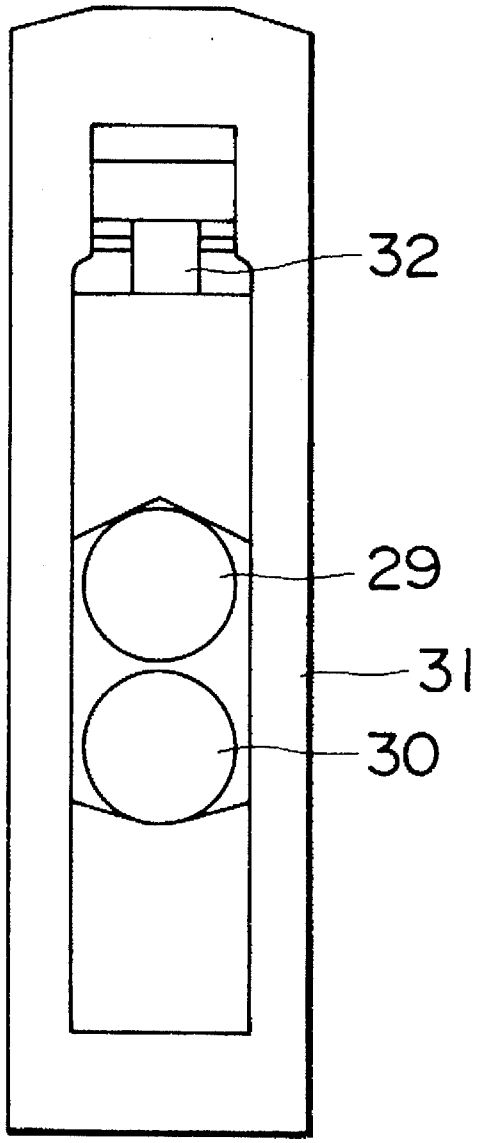
FIG. 11 is a schematic view of a thinning device in the fifth embodiment of the present invention.

Practical means of the thinning device 28 will now be described with reference to FIG. 11.

The thinning device includes a housing 31 in which a pair of upper and lower non-rotating rolls 29, 30 are disposed. A cylinder 32 is used to apply a load to the rolls thereby pressing the leading end portion of the strip.

In this case, the radius of each of the press rolls is required to be almost equal to that of each work roll of the $F_1$ mill. The larger radius of the press roll is more advantageous in biting the strip into the $F_1$ mill because the leading end portion of the strip is thinned to a larger extent.

Although the above description is made of only the finish mill in connection with achievement of the mini hot, it is required to make the entire structure compact and hold down the construction cost for achieving the mini hot as a whole. To this end, a new 2-high twin rough rolling mill comprising two 2-high mills installed together in one housing is proposed as the rough rolling mills of the hot rolling mill system.

Figure 12:
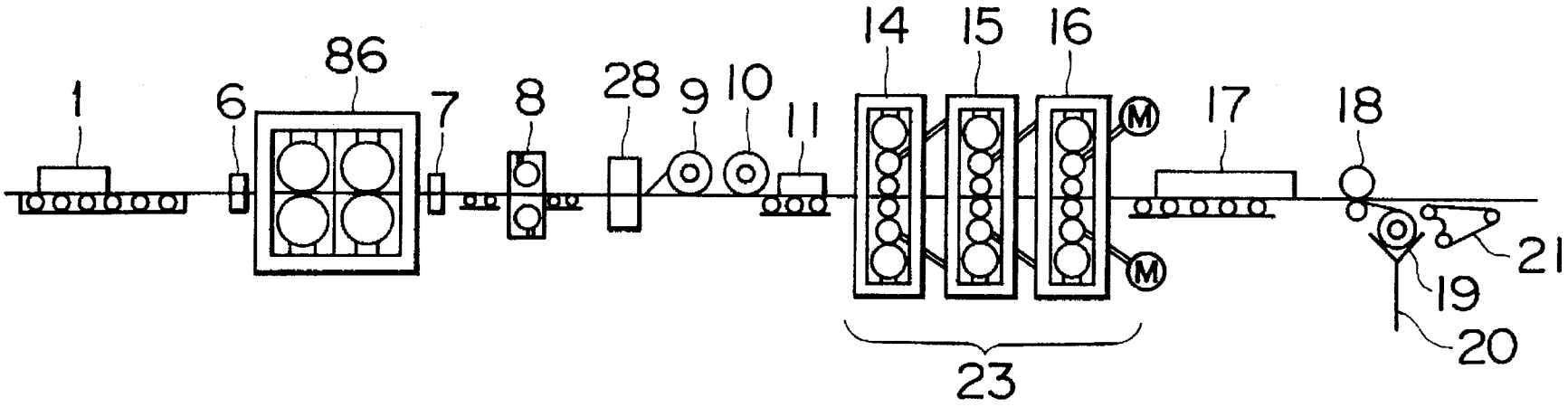
FIG. 12 is a schematic view of a hot rolling mill system showing a sixth embodiment of the present invention.

FIG. 12 is a schematic view of a hot rolling mill system showing a sixth embodiment of the present invention.

In this embodiment, since a rolling can be performed two times per pass, table lengths upstream and downstream of the rough rolling mill are shortened in the case of reversible rolling, and a temperature drop of the strip becomes smaller to thereby reduce the fuel cost. Further, since descaling is required to be made one time for twice rolling, cooling water and electric power are also saved. Additionally, since a finish rolling speed at the outlet of the finish rolling mill train is low, a hot run table can be reduced in its length from the standpoint of cooling ability as well, with the result that the entire layout can be shortened, which is favorable in meeting conditions of location.

With the embodiment shown in FIG. 12 in which a 2-high twin mill, as the rough rolling mill, comprising two 2-high mills incorporated in one stand is combined with a coiler disposed between the rough rolling mill and the finish rolling mill, when a slab of 210 mm thick and 12 m long is used as material, the entire length of the hot rolling mill system can be held down on the order of 170 m. Judging from the fact that even the hot rolling mill system constructed recently as a mini hot requires 250 m, the embodiment of FIG. 12 assures a great reduction in size and remarkable alleviation in limits of conditions of location.

It is needless to say that the 2-high twin mill of this embodiment can also be applied to any of the above-described embodiments shown in FIGS. 1 to 4 and FIG. 10.

Moreover, the 2-high twin mill may be replaced by a 2-high twin cross mill.

The above embodiments are each described as a mill including small-diameter work rolls of indirect driving type and capable of being applied to the finish rolling mill for realizing a mini hot. However, they can be improved into more effective mini hot equipments by solving technical problems to be discussed below.

There are two main problems.

One problem is how to deal with horizontal forces imposed on the small-diameter work rolls due to indirect driving. The other problem is insufficiency in control of the strip crown and configuration due to insufficient flexing rigidity of the small-diameter work rolls, i.e., a difficulty in adopting a usual 4-high mill.

For solving the first problem, it is usually conceived to provide a horizontal support roller for each work roll. This method is however not practical because, in hot rolling, the provision of guides, cooling water pipes, etc. leaves no sufficient space for installation of such support roller, and dust or scale cannot not be prevented from entering split bearings.

For the embodiments described above with reference to FIGS. 1 to 4, 10 and 12, therefore, it is here proposed to provide work rolls for each of the mills 14 to 16 in the finish rolling mill train 23 such that the work rolls are offset in the rolling direction with respect to axes of respective rolls held in contact with the work rolls, for thereby canceling out the horizontal forces due to indirect driving with a horizontal component of the rolling load. As a result, the small-diameter work rolls can be adopted without providing any auxiliary equipment around barrel portions of the work rolls. The amount of the offset is desirably adjustable depending on rolling conditions.

Figure 20:
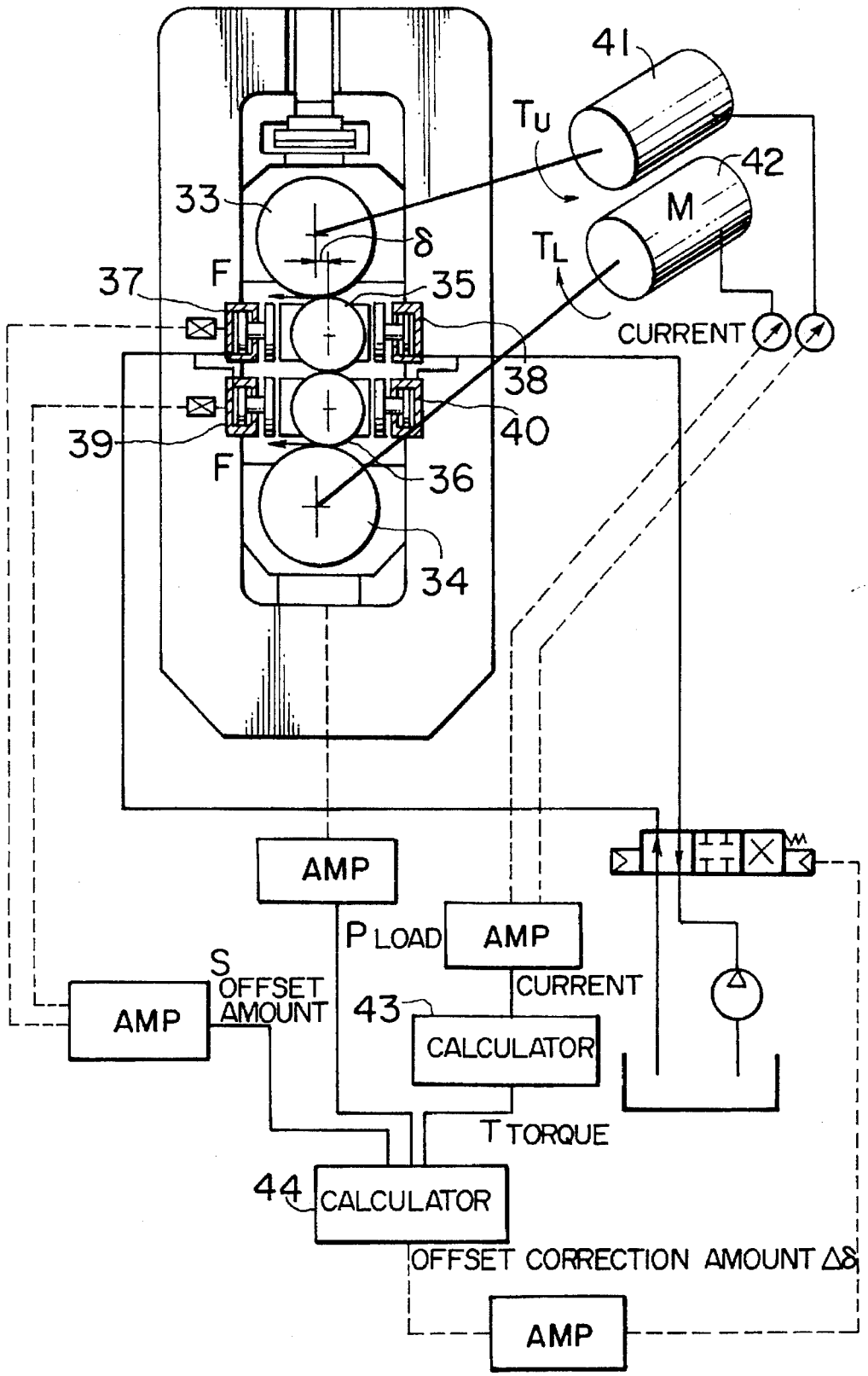
FIG. 20 is a schematic view of a finish rolling mill which is applicable to the first to sixth embodiments of the present invention, and a control block diagram thereof.

The above method is practiced as shown in FIG. 20, for example, by arranging a mill such that work rolls 35, 36 can be offset in the rolling direction by cylinders 37 to 40 with respect axes of backup rolls 33, 34.

A description will now be made of a method of adjusting the offset amount in such a mill.

Based on currents of motors 41, 42, rolling torques T ($T=T_U+T_L$, $T_U$ and $T_L$ being shown in FIG. 13) of the motors are by calculators 43 to determine driving tangential forces F of the work rolls 35, 36.

The driving tangential force F can be determined by the following Equation 7.

$$F=\frac{T}{D_B}=\frac{T_U+T_L}{D_B} \quad \text{(Eq. 7)}$$

$D_B$ is a diameter of each of the back-up rolls 33, 34.

In order that the above tangential force and a horizontal component $F_H$ of the loading load P due to the offset, $$F_H=P\sin\left(\frac{\delta}{\frac{D_W+D_B}{2}}\right) \quad \text{(Eq. 8)}$$

are balanced, an offset amount d of the work roll is adjusted by a calculator 44 based on the following Equation 9, for example. The horizontal forces imposed on the work roll are thereby balanced to minimize a horizontal flexure of each work roll.

Here, P is a rolling load and $D_B$ is a diameter of each of the back-up rolls 33, 34.

$$\delta=\frac{D_W+D_B}{2}\sin-1\left(\frac{1}{P}\cdot\frac{T}{D_B}\right) \quad \text{(Eq. 9)}$$

Thus, the offset amount of the work roll is adjusted in accordance with the result calculated as explained above.

The above-mentioned method can be applied to not only the rolling process but also the process of thinning the strip leading end portion.

As to the aforesaid second problem, mills suitable for small-diameter work rolls have recently been developed primarily in the art of cold rolling. Typical one of such mills is a 6-high mill including shiftable intermediate rolls, for example, as shown in FIG. 21.

For the embodiments described above with reference to FIGS. 1 to 4, 10 and 12, therefore, it is here proposed to replace each of the mills 14 to 16 in the finish rolling mill train 23 by a 6-high mill including shiftable intermediate rolls.

Figure 21:
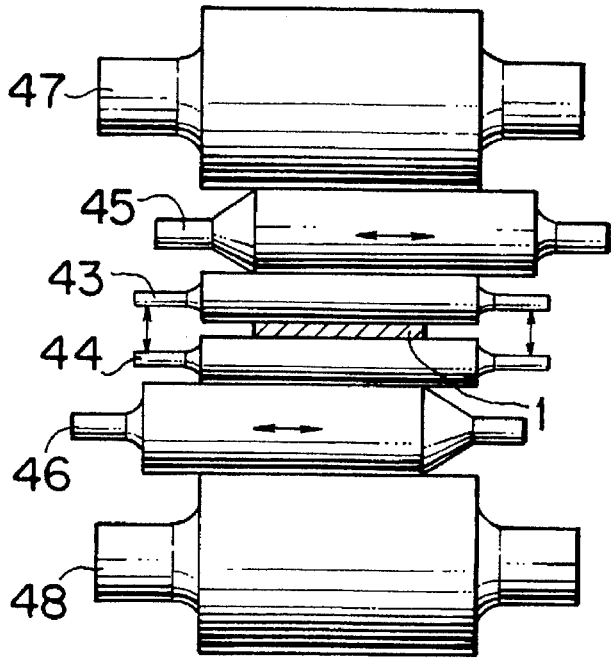
FIG. 21 is a schematic view of a finish rolling mill which is applicable to the first to sixth embodiments of the present invention.

A mill shown in FIG. 21 comprises a pair of upper and lower work rolls 43, 44, a pair of upper and lower intermediate rolls 45, 46 which are axially movable, and a pair of upper and lower back-up rolls 47, 48. By combining movements of the intermediate rolls 45, 46 with bending of the work rolls 43, 44, the thickness distribution of the strip in the widthwise direction thereof is controlled to control the strip crown and configuration (flatness). In this type of mill, the intermediate rolls 45, 46 are axially moved and the back-up rolls 47, 48 support the respective intermediate rolls.

Note that the above type of mill is not limited to the illustrated one in which the intermediate rolls are axially moved, but it may be modified such that the work rolls are moved axially, or such that the back-up rolls are moved axially.

Furthermore, methods of making rolls crossed each other in a 4-high mill have also been widely used in the art of hot rolling. These methods are also effective in solving the aforesaid second problem and can be realized by driving back-up rolls. This type of mill is shown, by way of example, in FIG. 22.

Figure 22:
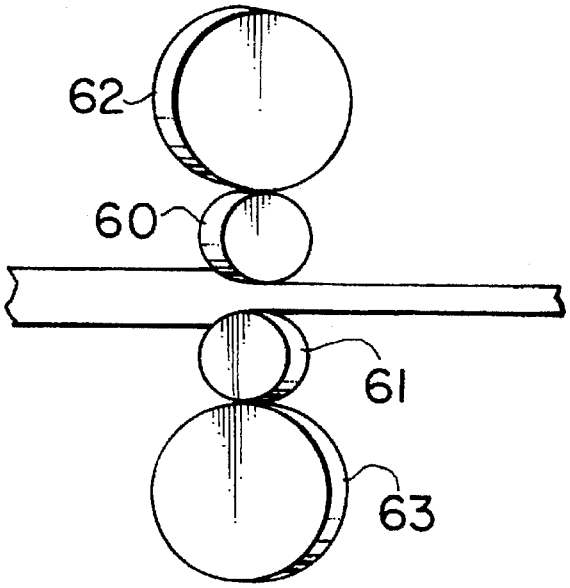
FIG. 22 is a schematic view of a finish rolling mill which is applicable to the first to sixth embodiments of the present invention.

The mill shown in FIG. 22 is a so-called PC mill comprising a pair of work rolls 60, 61 and a pair of back-up rolls 62, 63 supporting the respective work rolls, the pair of work rolls 60, 61 and the pair of back-up rolls 62, 63 being crossed each other in a horizontal plane to thereby control the widthwise thickness distribution of the strip.

For the embodiments described above with reference to FIGS. 1 to 4, 10 and 12, it is conceived to apply the above crossing type mill to each of the mills 14 to 16 in the finish rolling mill train 23.

Figure 23:
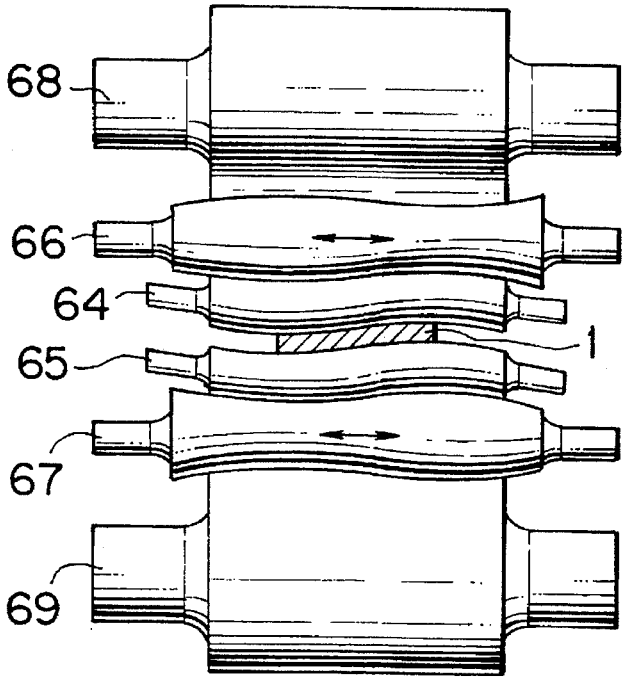
FIG. 23 is a schematic view of a finish rolling mill which is applicable to the first to sixth embodiments of the present invention.
Figure 24:
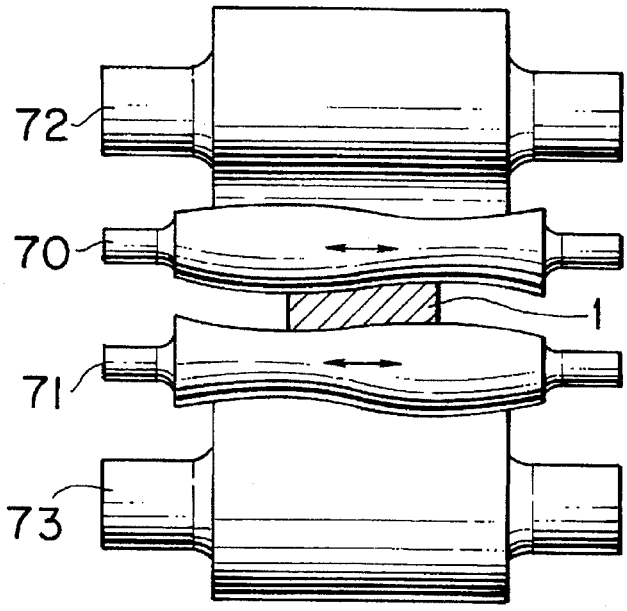
FIG. 24 is a schematic view of a finish rolling mill which is applicable to the first to sixth embodiments of the present invention.

In addition, as shown in FIGS. 23 and 24, mills using rolls having gourd-shaped crown configurations have been developed recently. These type mills can also be used in the present invention with an effective result.

The mills using such deformed rolls are shown in FIGS. 23 and 24. The mill shown in FIG. 23 comprises a pair of upper and lower work rolls 64, 65, a pair of upper and lower intermediate rolls 66, 67, and a pair of upper and lower back-up rolls 68, 69. The intermediate rolls 66, 67 have gourd-shaped crown configurations symmetrical to each other about a point and are movable in the roll axial direction. By moving the pair of intermediate rolls 66, 67 in opposite directions, the widthwise thickness distribution of the strip is controlled.

Also, the mill shown in FIG. 24 comprises a pair of upper and lower work rolls 70, 71 and a pair of upper and lower back-up rolls 72, 73. The work rolls 70, 71 have gourd-shaped crown configurations symmetrical to each other about a point and are movable in the roll axial direction. By moving the pair of work rolls 70, 71 in opposite directions, the widthwise thickness distribution of the strip is controlled. Those mills using deformed rolls can also have a function of concentrically modifying the configurations of the strip end portion with the axial movement of the gourd-shaped crowns.

Figure 25:
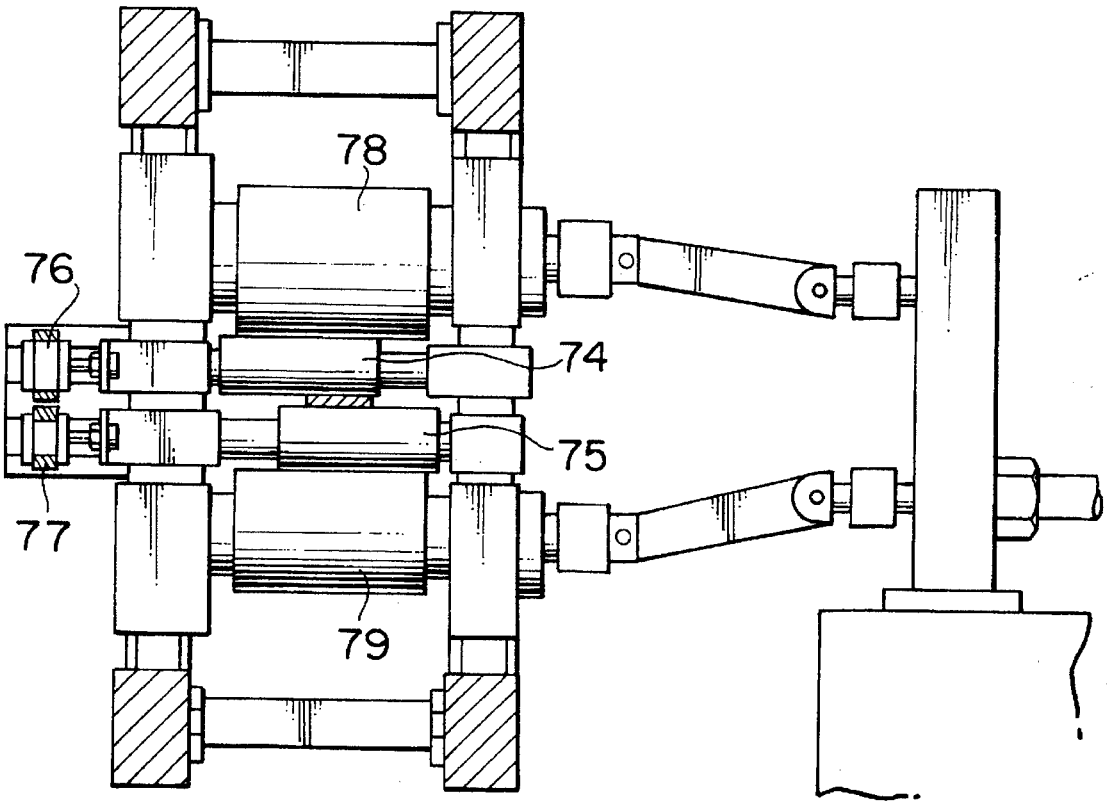
FIG. 25 is a schematic view of a finish rolling mill which is applicable to the first to sixth embodiments of the present invention.

A similar result can further be obtained by still another 4-high mill constructed, as shown in FIG. 25, such that work rolls 74, 75 are moved in the roll axial direction by shift devices 76, 77, respectively, for dispersing wears of the rolls due to rolling and thus reducing variation in the roll gap attendant on the wears.

In the mill shown in FIG. 25, back-up rolls 78, 79 are driven by not-shown drive motors through spindles.

Figure 26:
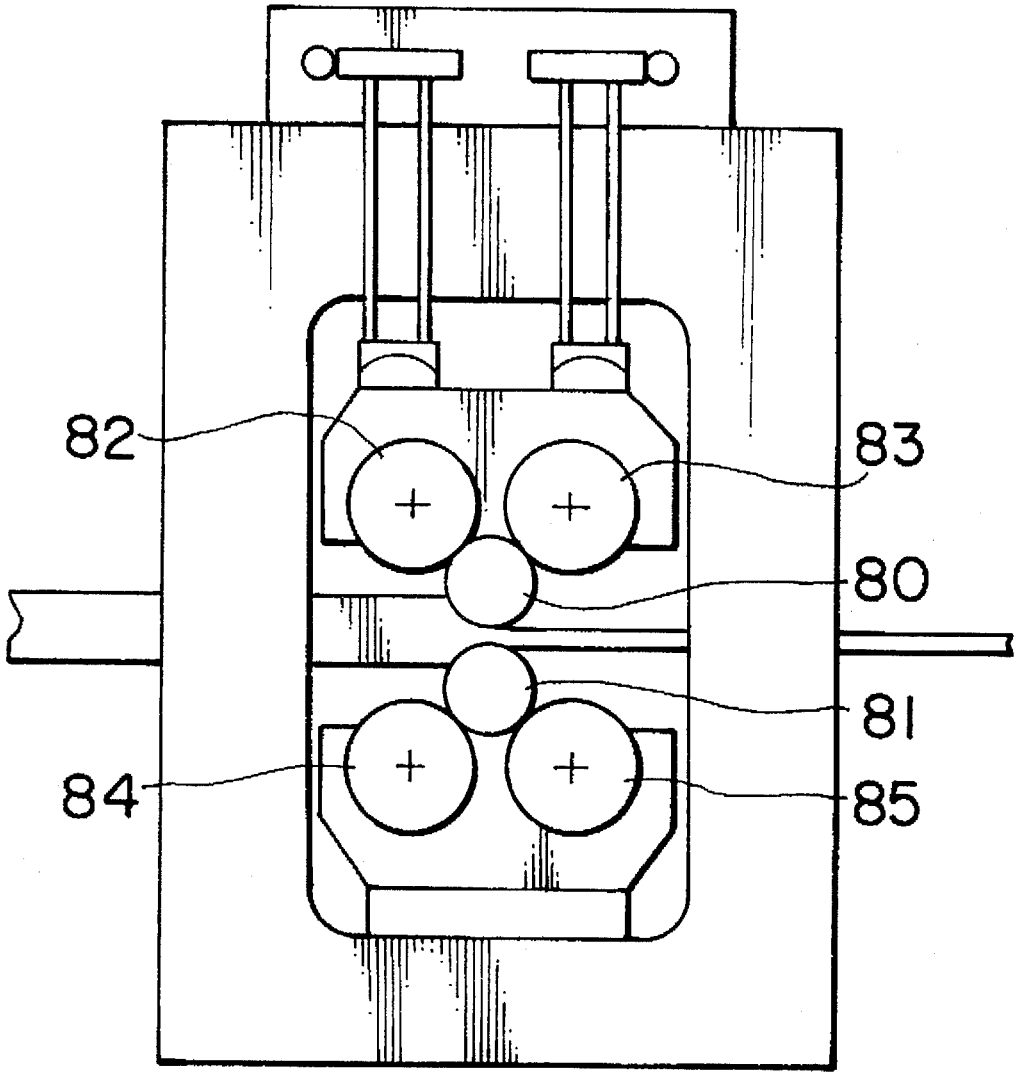
FIG. 26 is a schematic view of a finish rolling mill which is applicable to the first to sixth embodiments of the present invention.

Moreover, a similar result can be obtained from a cluster mill constructed, as shown in FIG. 26, such that a pair of work rolls 80, 81 are supported by a plurality of back-up rolls 82 to 85.

In the embodiments described above, for the reasons that small-diameter work rolls are used in the finish rolling mills and the rolling is performed at strong draft, there is a possibility that frequency of roll exchange is increased with respect to an amount of the rolling even if a roll wear per unit amount of the rolling is the same. This problem can be avoided by providing an online roll grinder.

Additionally, if a high-speed steel roll developed recently is used as each of the work rolls of the mills constituting the finish rolling mill system, it is possible to ensure high strength, facilitate a reduction in diameter, and reduce the roll wear down to a fraction of that occurred in the past.

Here, the term "high-speed steel roll" means a roll which is superior in wear resistance and in resistance against texture roughness, and hence which has recently attained more widespread use as a roll for hot rolling.

The high-speed steel roll is a cast-iron based composite roll of double structure comprising inner and outer layers. The outer layer of the roll is formed of high carbon high-speed steel material and the inner layer (core) is formed of tough material, e.g., cast steel.

Therefore, the high-speed steel roll exhibits a wear on the order of ¼ to ⅕ of that caused in a conventional nickel grain roll, is endurable for a longer period of time, and can prolong a roll exchange cycle to a large extent.

A description will now be made of the coil box and the descaling device in the embodiments of the present invention explained above with reference to FIGS. 1 to 4, 10 and 12.

Figure 27:
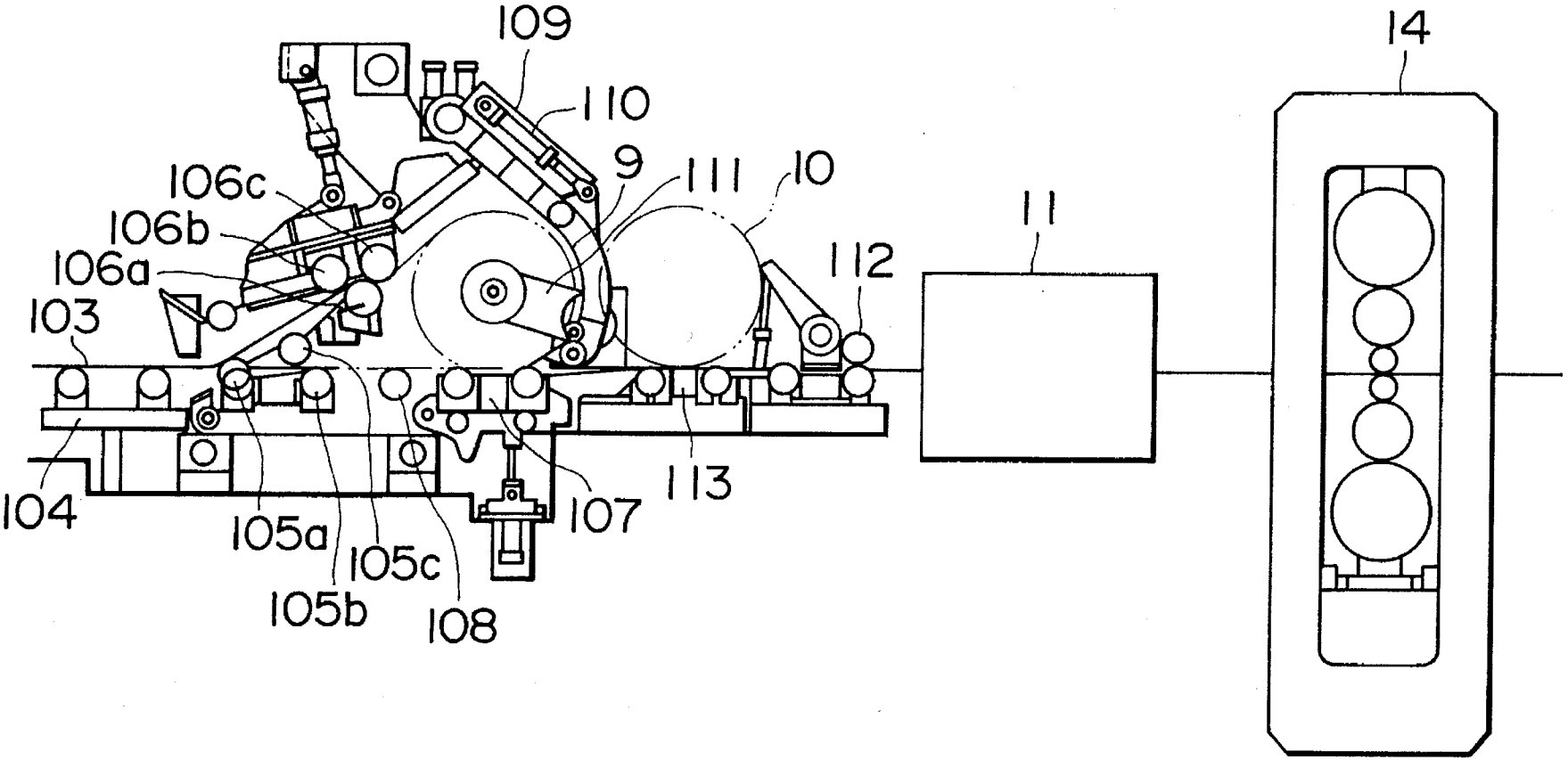
FIG. 27 is a schematic view of a coil box and a descaling device which are applicable to the first to sixth embodiments of the present invention.

FIG. 27 is a schematic view of the coil box and the descaling device in any of the embodiments of the present invention. A strip 103 delivered from the rough rolling mill is conveyed over a delay table 104 to a coil box 9. Deflector roll 105*a*, 105*b*, 105*c* are provided at an inlet of the coil box 9 to guide the leading end portion of the strip 103 upwardly toward bending rolls 106*a*, 106*b*, 106*c*.

The bending rolls 106*a*, 106*b*, 106*c* bend the strip 103 into a predetermined radius of curvature so that the strip is rolled into a coil on a No. 1 cradle roll 107.

A forming roll 108 is a guide for causing the strip 103 to be easily reeled up on the No. 1 cradle roll 107.

When the strip 103 is completely reeled up above the No. 1 cradle roll 107, rotation of the coil is stopped by braking a cradle roll driving motor (not shown). Subsequently, it is required to lead out a tailing end of the coil which becomes a leading end thereof when the coil is reeled out. A peeler 109 is used to lead out the leading end of the coil. The peeler 109 is normally retracted by a cylinder 110 to a position above the coil. When the leading end of the coil is led out, the peeler 109 is set at the illustrated position and, by rotating the cradle roll 107 backwardly, it acts to separate the leading end of the coil away from the coil. Thereafter, the leading end of the coil is held between pinch rolls 112, and forwarded to the descaling device 11 and then to the finish rolling mill 14.

On the other hand, the formed coil is supported at its inner peripheral portion by a transfer press arm 111 and carried to a No. 2 cradle roll 113 where the coil is unreeled.

Figure 28:
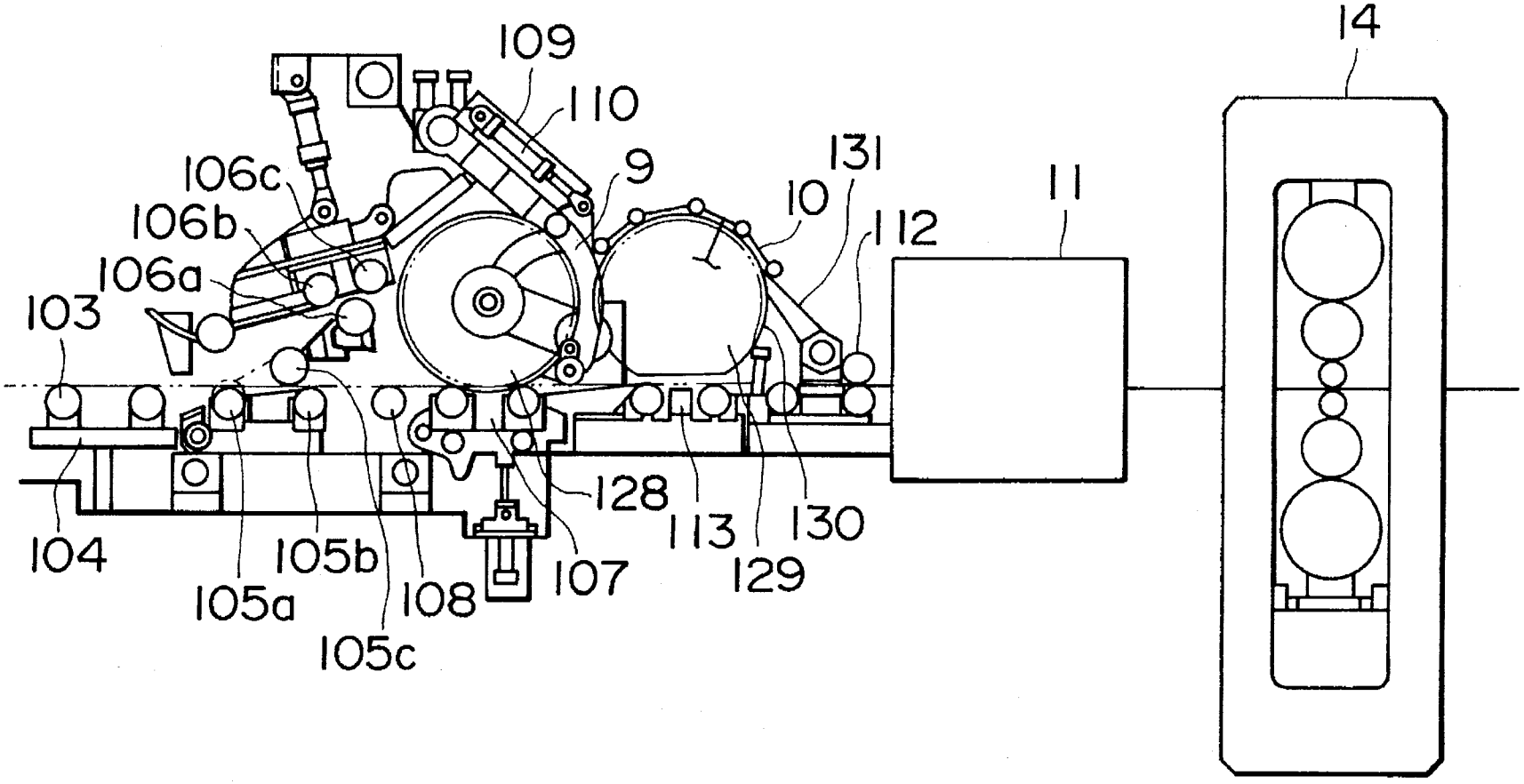
FIG. 28 is a schematic view of a coil box and a descaling device which are applicable to the first to sixth embodiments of the present invention.

FIG. 28 is a schematic view of the coil box and the descaling device in each of the embodiments of the present invention. A heat insulating cover 128 is provided to prevent a temperature drop of the strip, particularly, at edge portions thereof due to heat radiation through the edge portions, during the time when the strip 103 is reeled up in the coil box 9 and then fed to the finish rolling mill 14 from the coil unreeling position 10. The heat insulating cover is of a cover lined with heat insulating material, e.g., glass wool, and is placed so as to wrap the coil for preventing heat radiation from the coil. In same cases, the heat insulating cover may be provided with a heater on its inner surface to serve also as an edge heater. The heat insulating cover 129 is constructed such that it can be rotated in the coil unreeling position 10 by a cylinder 130 through an arm 131 and retracted to be out of interference with the coil when the coil is transferred from the coil reeling position to the coil unreeling position.

Figure 29:
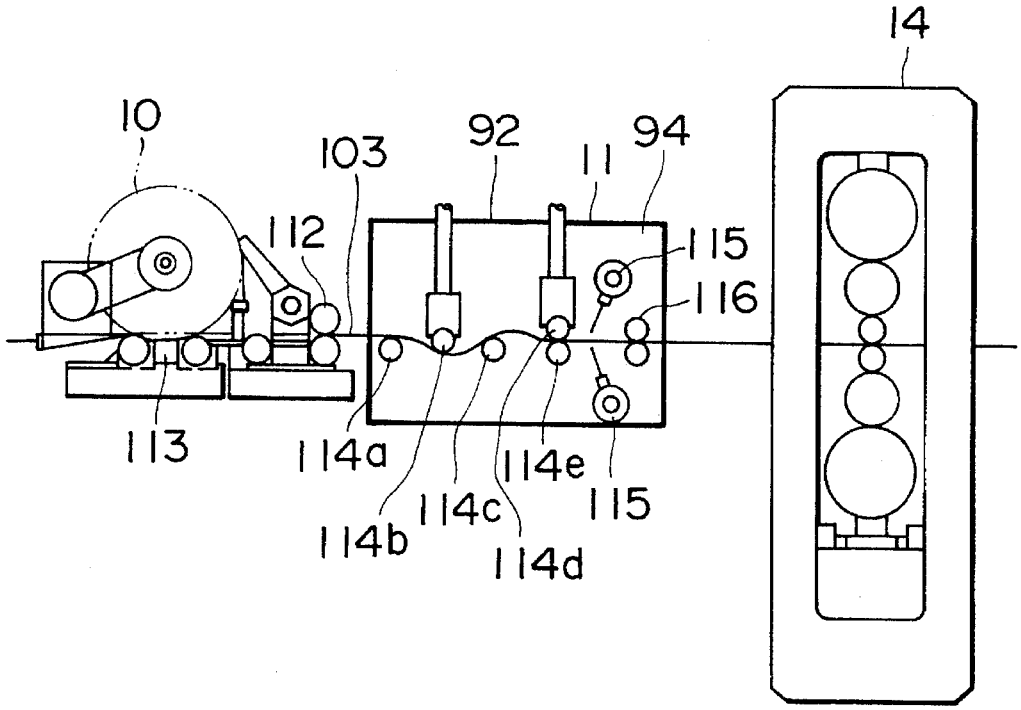
FIG. 29 is a schematic view for explaining details of a descaling device which is applicable to the first to sixth embodiments of the present invention.
Figure 30:
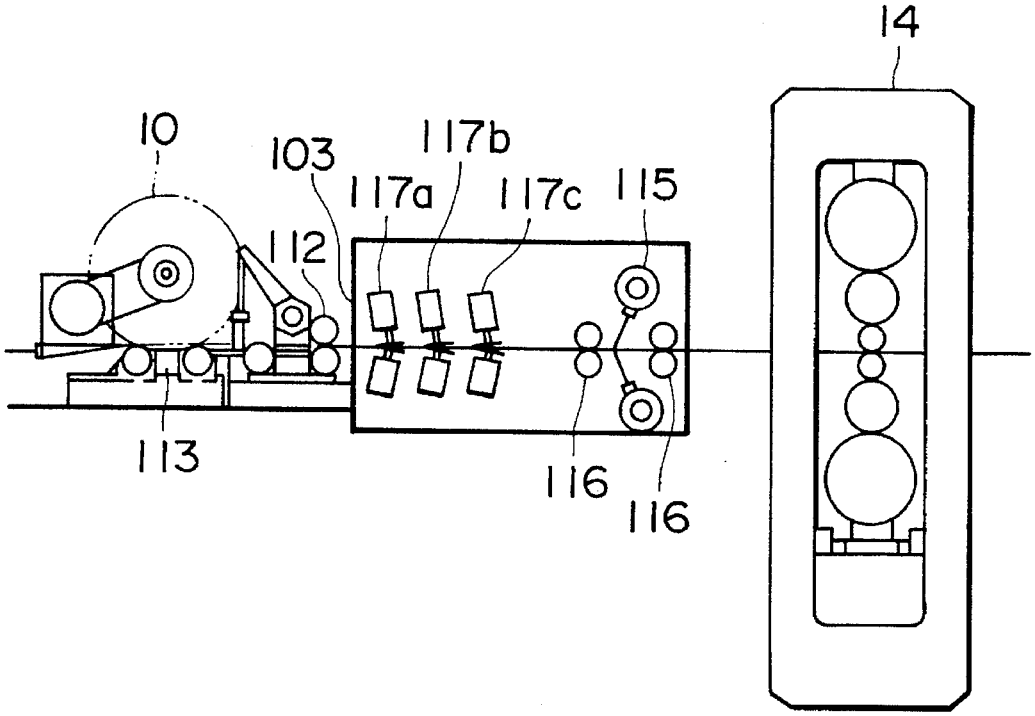
FIG. 30 is a schematic view for explaining details of a descaling device which is applicable to the first to sixth embodiments of the present invention.
Figure 31:
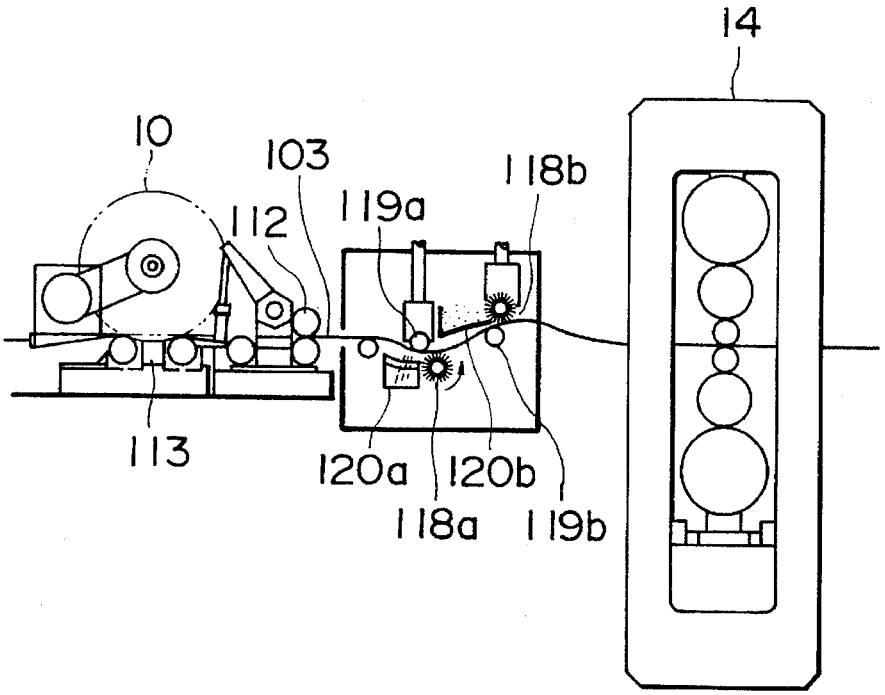
FIG. 31 is a schematic view for explaining details of a descaling device which is applicable to the first to sixth embodiments of the present invention.

FIGS. 29 to 31 are schematic views for explaining the structural details of the descaling device 11 adapted to remove scale, which is detrimental to finishing of products, before the strip is fed into the finish rolling mill.

Since the speed at the finish mill delivery side is not more than 300 m/minute in the present invention, the speed at the entry side of the No. 1 stand 14 in the finish rolling mill train is from 20 to 30 m/minute. Therefore, if the descaling is performed only with water jets as conventionally, the temperature of the strip 103 is too lowered to hold a strip temperature required at the entry side of the finish rolling mill 14, e.g., 930° C.

In the embodiment of FIG. 29, the strip 103 reeled out of the coil unreeling position 10 in the coil box is fed by the pinch rolls 112 to the descaling device 11 which is constructed as a mechanical scale breaker. More specifically, bending rollers 114*a* to 114*e* are disposed to bend the strip 103 for causing cracks in scale on the surface of the strip 103, and the scale is peeled off by water jets 115. Then, the strip 103 is fed by pinch rollers 116 to the finish rolling mill 14.

Since the scale on the surface of the strip 103 is first cracked and then removed as pointed out above, a pressure and amount of each of the water jets 115 can be made lower and smaller than those required for the case in which scale is not cracked beforehand. Accordingly, it is possible to suppress a temperature drop of the strip 103 and ensure a desired temperature of the strip even in low-speed rolling.

In the embodiment of FIG. 30, disk type grinders 117*a* to 117*c* are provided instead of the scale breaker employed in the embodiment described above with reference to FIG. 29, for thereby removing scale on the surface of the strip 103 in cooperation with the water jets 115. Then, the strip 103 is fed by the pinch rollers 116 to the finish rolling mill 14.

In this case, although the disk type grinders 117 as a mechanical descaler and the water jets can be used independently for removing the scale, the combined use thereof can remove the scale with a higher reliability.

In the embodiment of FIG. 31, brush rolls 118*a*, 118*b* are used instead of the scale breaker in the embodiment described above with reference to FIG. 29, for thereby removing the scale. Facing the brush rolls 118*a*, 118*b*, respectively, bending rollers 119*a*, 119*b* are disposed to bend the strip 103 for causing cracks in scale on the surface of the strip 103, and the scale is removed by the brush rolls 118*a*, 118*b*.

Additionally, to collect the scale removed, scale collecting devices 120*a*, 120*b* are provided in the vicinity of the brush rolls 118*a*, 118*b*.

Figure 32:
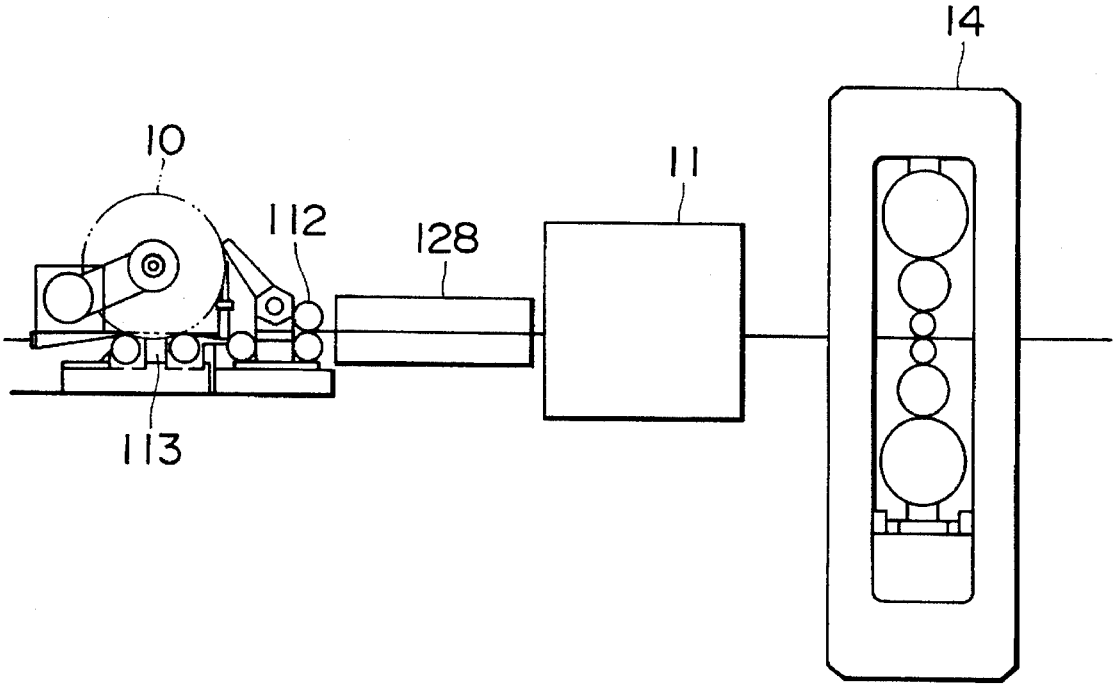
FIG. 32 is a schematic view showing an induction heater for heating disposed between the coil box and the descaling device in the first to sixth embodiments of the present invention.

FIG. 32 shows an embodiment in which an induction heater 128 for heating is disposed between the coil box and the descaling device 11. The induction heater is a bar heater or an edge heater and serves to prevent a temperature drop of the strip in the descaling device 11. Providing the induction heater is effective when the temperature drop is inevitable to some extent depending on a thickness of the strip, type of the descaler, etc.

In the above-described hot rolling mill system according to the present invention, a length between the finish rolling mills is preferably as short as possible for the purposes of reducing the temperature drop of the strip in the finish rolling mill train and also suppressing a zigzag motion of the strip to ease proper threading of the strip through the train.

Figure 33:
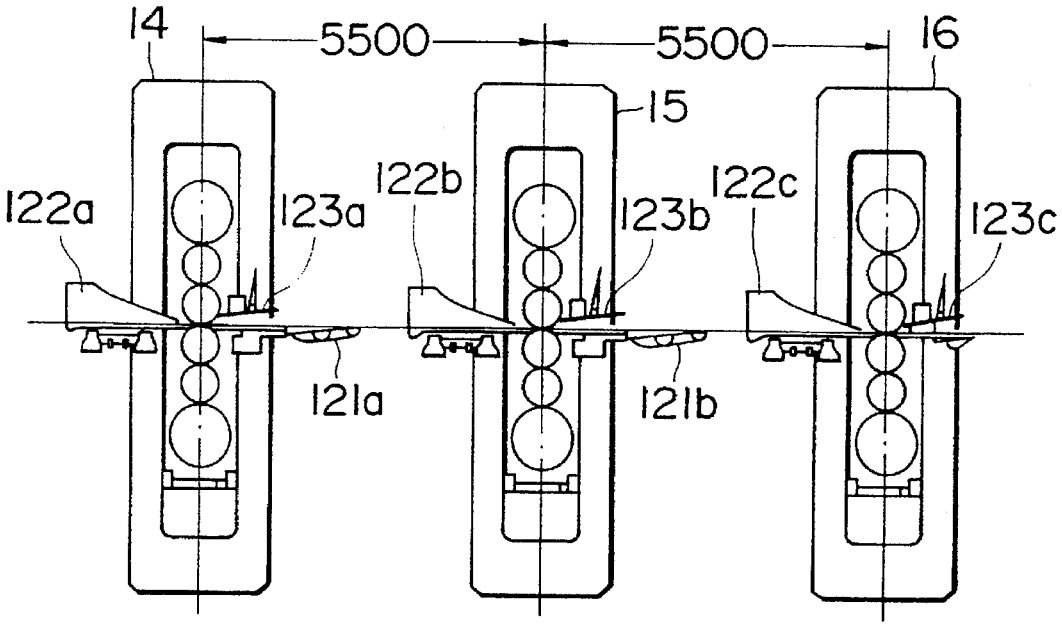
FIG. 33 PRIOR ART
FIG. 33 is a schematic view showing portions between finish rolling mills in prior art.

Speed differences between the finish rolling mills were conventionally adjusted by loopers 121*a*, 121*b* provided therebetween, as shown in FIG. 33. Therefore, installation spaces for the loopers 121*a*, 121*b* operated with lever motions were required, so that a stand-to-stand length was set at about 5.5 m.

Figure 34:
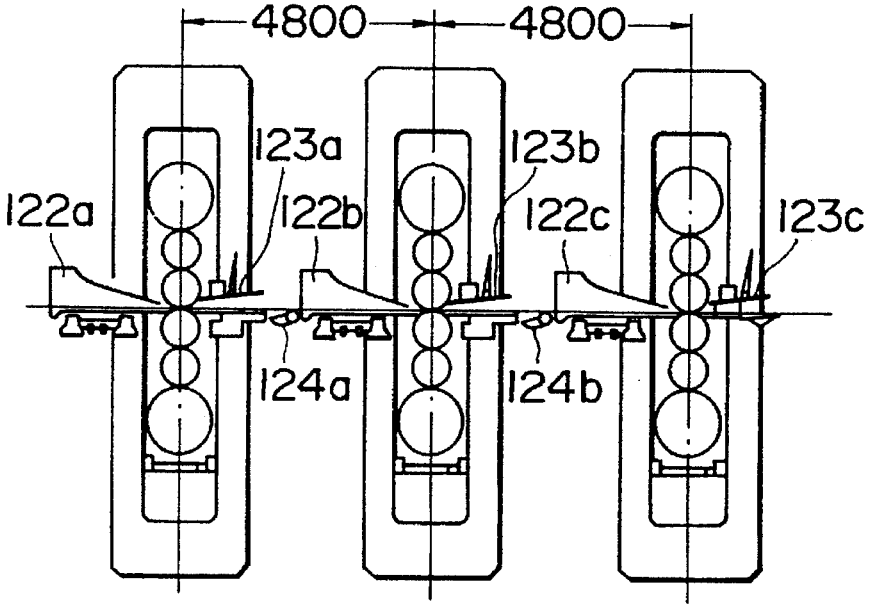
FIG. 34 is a schematic view showing portions between the finish rolling mills according to the first to sixth embodiments of the present invention.

On the other hand, partly because of the low finish rolling speed, the embodiment of the present invention can be constructed just by eliminating the loopers or providing tension measuring devices 124*a*, 124*b* for controlling the strip thickness, as shown in FIG. 34, whereby a mill-to-mill spacing can be shortened to 4.8 m. Accordingly, proper threading of the strip through the finish rolling mill train is facilitated.

Note that denoted by 122*a* to 122*c* in FIGS. 33 and 34 are side guides and 123*a* to 123*c* are water wiping guides.

Figure 35:
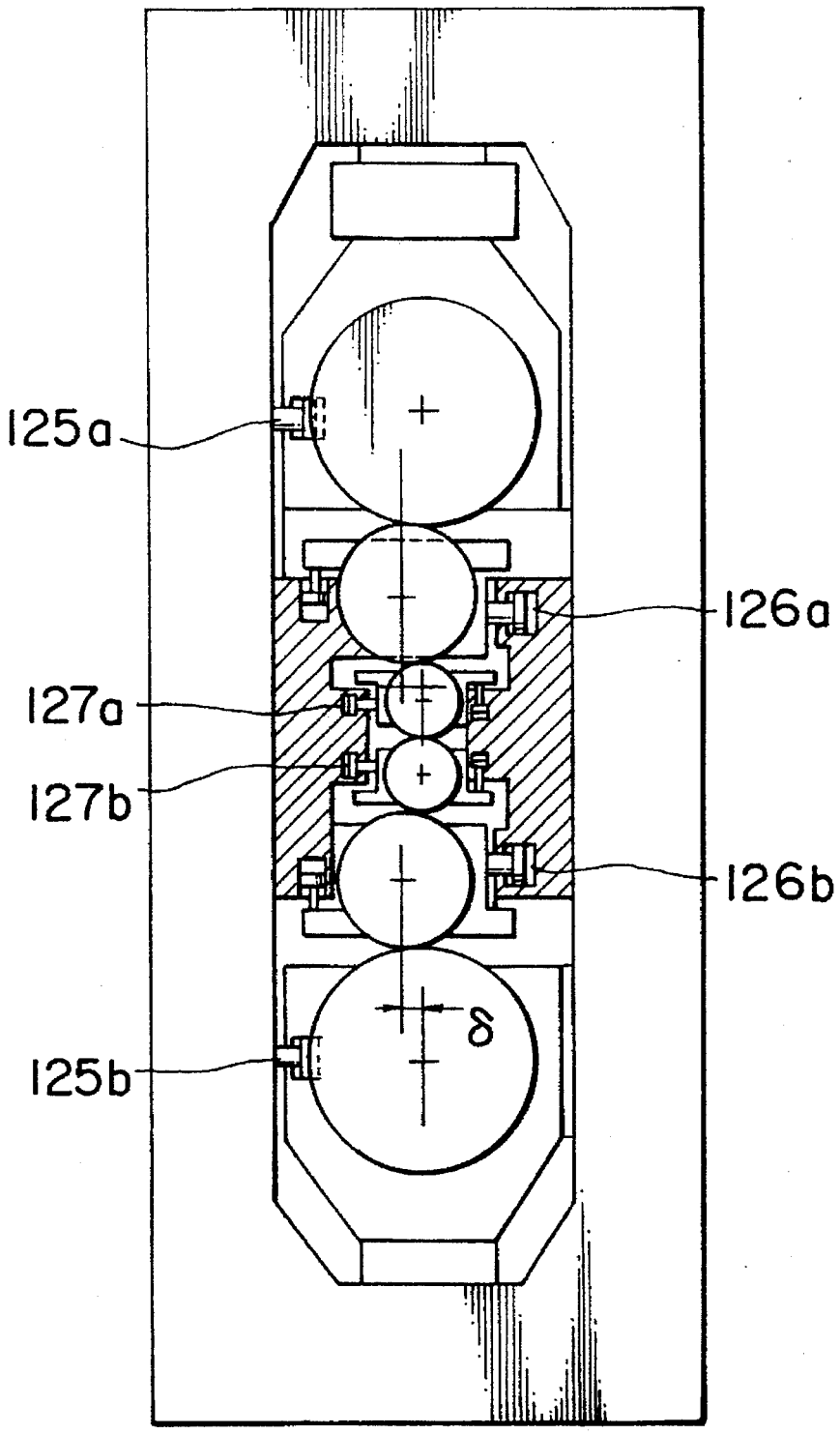
FIG. 35 is a schematic view of a mill provided with chattering preventing mechanisms which are applicable to the first to sixth embodiments of the present invention.

FIG. 35 shows a finish rolling mill provided with a chattering preventing mechanism adapted to prevent horizontal movement of the rolls when the strip is engaged into or disengaged from the mill.

Pairs of chattering preventing mechanisms 125*a*, 125*b*, 126*a*, 126*b*, and 127*a*, 127*b* are associated with the back-up rolls, the intermediate rolls and the work rolls, respectively and, after the rolls are inserted in the stand, they press the corresponding rolls against the entry side or the delivery side for making clearances therebetween zero. As a result, the strip can be prevented from being curved or having a zigzag motion. In particular, it is possible to prevent the strip from being disturbed in properly threading the mills due to unstable movements of the small-diameter work rolls caused in the rolling direction during the finish rolling at a strong draft as with the embodiments of the present invention, and hence to surely develop characteristics of the small-diameter work rolls.

With the above-described embodiments of the present invention, small-scale production of hot strips can be performed with a small-scale equipment. While an annual yield most keenly demanded at present is on the order of one million tons, a production amount Q is given below on condition that product sizes are 100 mm wide and 2.0 mm thick in average and the system is operated for 500 hours per month:

$$Q=2.0\times10^{-3}\times1.0\times240\times60\times500\times12\times7.85=1{,}356{,}480 \text{ tons}$$

Taking into account an idle time between the coils, the annual yield of one million tons can be produced sufficiently. If that rolling is carried out by a 3-stand tandem including work rolls of which diameter is 300 mm, a total finish power is just 14,600 KW.

Further, the finish temperature can be held at 900° C. In the conventional systems, a work roll diameter is about 700 mm in average and at least 5 stands are installed. Thus, the prior art including 5 stands requires a rolling speed not less than 500 m/minute to avoid an excessive drop of the finish temperature and a rolling power of 33,000 KW, i.e., 2.2 times or more as much as the present invention; namely, it requires a power source having extra capacity enough to supply the difference of 18,000 KW therebetween. Further, the 5 stands, which are two stands more than the 3 stands in the present invention, lead to a larger scale plant. If the number of stands in the prior art is reduced to 3, the finish temperature could be held with 240 m/minute, but a work roll diameter would be increased to 800 mm for the necessity of greater spindle strength to enable work roll driving, whereby a rolling load would be about 4000 tf and a mill itself would be increased in both size and cost as inevitable results from a remarkable increase in a roll housing size and in a back-up roll diameter. In addition, a larger work roll diameter increases an energy loss due to the slip friction between a roll and a strip. As compared with a total power of 14,600 KW required for a 300 mm work roll, a total power of 21,000 KW is required for a 800 mm work roll at the same rolling speed, meaning a power loss not less than 40%. For a large work roll diameter, a strip temperature is cooled to a greater extent through rolls because of a greater contact length between the strip and each of the rolls. The reason why a temperature of the large-diameter roll is not so lowered as a whole as with a small-diameter roll is that the slip friction is increased with a larger diameter of the work roll and more heat is produced to compensate for the temperature drop of the strip. Although the above temperature calculation was made by assuming the stand-to-stand distance to be 5.5 m, the supposed large-size mill would require a back-up roll diameter not less than 1600 mm and a larger roll housing, resulting in a stand-to-stand distance of 6 m. In contrast, the embodiments of the present invention require a rolling load about a half of that for the prior art, a back-up roll diameter not more than 1200 mm and a smaller roll housing, resulting in a stand-to-stand distance of 4.5 m. This is effective to not only further prevent a temperature drop, but to also prevent the occurrence of scale on the strip surface between stands which would be otherwise a problem in a low-speed rolling.

Also, the embodiments of the present invention provide the following advantages for equipment on the delivery side of a hot strip mill.

In a hot strip mill, it is generally necessary that a strip be cooled on a hot line table between a finish mill and a down coiler to lower a strip temperature from the finish temperature to the reeling temperature. However, a cooling rate is limited, so that a longer hot run table is required for a greater rolling speed. According to the embodiments of the present invention, since a low-speed rolling is possible, a hot run table can be shortened correspondingly and hence an entire plant length can be reduced. Further, the conventional reeling device is usually constructed to reel up a strip by pressing it around a drum, called as a down coiler, by means of three or four wrapper rollers. However, a subsequent coil strip is caused to impact against the wrapper rollers at a step formed by a leading end portion of the strip, thereby producing marks and lowering the yield. While a method of jumping the wrapper rollers at such a step has recently been employed to overcome the above problem, the method requires a complex mechanism and the equipment at this part still requires the safest maintenance all over the hot mill plant. In the embodiments of the present invention, a chain type belt wrapper is employed as the down coiler by utilizing the characterized features of low-speed rolling, i.e., low-speed reeling, with the resultant improvements in the yield and safety in maintenance and also remarkable reduction in the equipment cost.

As described above, the present invention can provide a hot strip rolling mill system and method by which small-scale production of hot strips can be realized with a compact structure of equipment.

What is claimed is:

1. A hot rolling mill system comprising:

a rough rolling mill, and a finish rolling mill disposed downstream of the rough rolling mill, said finish rolling mill including:

at least one rolling mill stand with small work rolls of a diameter of not greater than 450 mm, said work rolls being indirectly driven by respective driven rolls engaging an outer circumference of the respective small work roll, at least one additional rolling mill stand disposed upstream of said at least one rolling mill stand, and a selectively operable strip loading end reducing device at the additional rolling mill stand which is operable to reduce a thickness of a leading end of hot material strip from the rough rolling mill to enable said work rolls of said at least one rolling mill stand to bite the thus reduced hot material strip leading end, said strip leading end reducing device being switchable after said leading end has been reduced in thickness to facilitate finish rolling utilizing paid at least one additional rolling mill stand.

2. A hot rolling mill system according to claim 1, comprising work roll offset means for offsetting axes of upper and lower work rolls of said at least one rolling mill stand with small work rolls toward a strip delivery side in a rolling direction with respect to axes of upper and lower driven rolls so that driving tangential forces applied to said work rolls are reduced by a horizontal component of a rolling load.

3. A hot rolling mill system according to claim 2, wherein said work roll offset means is adjustable depending on rolling conditions.

4. A hot rolling mill system according to claim 1, comprising a roll bending device for adjusting a flexure of a corresponding roll of said at least one rolling mill stand for changing strip crown of a strip being rolled.

5. A hot rolling mill system according to claim 1, wherein the at least one rolling mill stand with small work rolls which are driven by back-up rolls or intermediate rolls is a mill in which pairs of said work rolls and driven rolls are crossed with respect to each other for varying a profile of a roll-to-roll gap and thereby changing a strip crown of a strip being rolled.

6. A hot rolling mill system according to claim 1, wherein: the at least one rolling mill stand with small work rolls is a mill in which at least one of said work rolls and driven rolls are formed to have curved surfaces asymmetrical about a pass center of said mill, but symmetrical about a point in a vertical direction, said rolls being movable in a roll axial direction for varying a profile of a roll-to-roll gap.

7. A hot rolling mill system according to claim 1, wherein: the at least one rolling mill stand with small work rolls is a 4-high or 6-high mill in which the work rolls are movable in a roll axial direction for dispersing wear of said rolls due to rolling so that variations in a roll-to-roll gap due to wear is made small.

8. A hot rolling mill system according to claim 1, wherein: the at least one rolling mill stand with small work rolls is a 6-high mill in which intermediate rolls are movable in a roll axial direction or, in addition, said work rolls or said intermediate rolls or both said work rolls and said intermediate rolls are each provided with a roll bending device for adjusting a flexure of the corresponding roll to change strip crown of a strip being rolled.

9. A hot rolling mil system according to claim 1, wherein: the at least one rolling mill stand with small work rolls is a cluster mill in which said work rolls are each supported by a plurality of back-up rolls.

10. A hot rolling mill system according to claim 1, wherein:

high-speed steel rolls are used as the work rolls of at least one of the mill stands constituting said hot finish rolling mill.

11. A hot rolling mill system according to claim 1, wherein;

at least one of the mill stands constituting said hot finish rolling mill is provided with a roll grinder.

12. A hot rolling mill system according to claim 1, wherein:

said rough rolling mill is a 2-high twin mill having two sets of upper and lower work rolls incorporated in one roll housing.

13. A hot rolling mill system according to claim 1, wherein:

said rough rolling mill is a 2-high twin crossing mill having two sets of upper and lower work rolls incorporated in one roll housing and each pair of said work rolls are crossed with respect to each other.

14. A hot rolling mill system according to claim 1, wherein:

said rough rolling mill is provided with a roll grinder.

15. A hot rolling mill system according to claim 1, wherein:

a reeling/unreeling coiler including a heat keeping cover is provided on an entry side of said hot finish rolling mill for once reeling a bar rolled by said rough rolling mill.

16. A hot rolling mill system according to claim 15, wherein:

said heat keeping cover includes a heater for preventing temperature drop of said bar.

17. A hot rolling mill system according to claim 1, wherein:

a descaling device including bending rolls is provided on an entry side of said hot finish rolling mill, said bending rolls serving to bend said hot material strip and cause cracks in scale on a surface of the hot material strip for mechanically removing the scale.

18. A hot rolling mill system according to claim 17, wherein:

said descaling device for mechanically removing scale on the bar surface is combined with a descaler operable with a water jet.

19. A hot rolling mill system according to claim 1, wherein:

a disk type grinder or a brush roll is provided on an entry side of said hot finish rolling mill for mechanically removing scale from a surface of the hot material strip.

20. A hot rolling mill system according to claim 1, wherein:

a reeling/unreeling device and a descaler are disposed on an entry side of said hot finish rolling mill, and an induction bar heater or an edged heater is disposed between said reeling/unreeling device and said descaler.

21. A hot rolling mill system according to claim 1, wherein:

a stationary tension measuring roll is disposed between every two mill stands constituting said hot finish rolling mill for carrying out looper-less rolling to shorten a distance between said every two mill stands.

22. A hot rolling mill system according to claim 1, wherein: the mill stands constituting said hot finish mill are each provided with a chock chattering restraining device which restrains a corresponding work roll chock in a rolling direction to hold said work roll from moving horizontally when a strip of material being rolled is engaged into and disengaged from said mill, thereby suppressing a curved or zigzag motion of said strip.

23. A hot rolling mill system according to claim 1, wherein:

the mill stands constituting said hot finish rolling mill are each provided with a chock chattering restraining device which restrains a corresponding intermediate roll chock or back-up chock in a rolling direction to hold the corresponding roll from moving horizontally when a strip of material being rolled is engaged into and disengage from said mill, thereby suppressing a curved or zigzag motion of said strip.

24. A hot rolling mill system according to claim 1, wherein said at least one additional rolling mill stand is a 2-high mill, and wherein said strip leading end reducing means includes means for changing a gap between work rolls of the 2-high mill.

25. A hot rolling mill system according to claim 1, wherein said at least one additional rolling mill stand is a further rolling mill stand with small work rolls of a diameter of not greater than 450 mm, said small work rolls being indirectly driven by respective driven rolls engaging an outer circumference of the respective small work rolls, and wherein said strip leading end reducing means includes means for changing a gap between the small work rolls of the additional rolling mill stand.

26. A hot rolling mill system according to claim 25, wherein:

a mill stand disposed in an upstream stage of said hot finish rolling mill is a mill stand capable of thinning a leading end portion of said hot material in cooperation with a hydraulic pressing device which is used for normal rolling.

27. A hot rolling mill system according to claim 25, wherein:

a mill stand disposed in an upstream stage of said hot finish rolling mill is a mill stand capable of thinning a leading end portion of said hot material by a hydraulic pressing device provided separately from a hydraulic pressing device which is used for normal rolling.

28. A hot rolling mill system according to claim 25, wherein:

a mill stand disposed in an upstream stage of said hot finish rolling mill is a mill stand capable of thinning the leading end portion of said hot material with the aid of a servo valve having a capacity not less than 300 l/minute.

29. A hot rolling mill system according to claim 1, wherein the finish rolling mill includes a plurality of said rolling mill stands with small work rolls of a diameter of not greater than 450 mm, each of said small work rolls of each of said plurality of rolling mill stands being indirectly driven by respective driven rolls engaging an outer circumference of the respective small work rolls, wherein said at least one additional rolling mill stand is a most upstream one of said plurality of said rolling mill stands with small rolls, and wherein said strip leading end reducing means includes means for changing a gap between the small work rolls of said most upstream of said rolling mill stands with small work rolls.

30. A hot rolling mill system according to claim 29, wherein:

a coiler for reeling up a strip of material being rolled is disposed on at least one of an entry and a delivery side of the strip leading end reducing means which is disposed on an entry side of said hot finish rolling mill, and an end portion of said coiled strip is thinned by said strip leading end reducing means.

31. A hot rolling mill system according to claim 1, wherein said at least one additional rolling mill stand includes a 2-high rolling mill stand with large work rolls having a diameter great than 450 mm, and wherein said strip leading end reducing means include means for changing a gap between said large work rolls of said 2-high rolling mill stand.

32. A method of making a rolled material strip comprising the sequential steps of:

supplying hot material strip to a rough rolling mill and rough rolling same therein, and finish rolling the hot material strip in a finish rolling mill disposed downstream of the rough rolling mill, wherein said finish rolling includes:

rolling said hot material strip in a plurality of rolling mill stands with small work rolls of a diameter of not greater than 450 mm, said small work rolls being indirectly driven by responsive driven rolls engaging and outer circumference of the respective small work rolls, and reducing a thickness of a leading end portion of said hot material strip in at least one additional rolling mill stand disposed upstream of said plurality of rolling mill stands with small work rolls to enable said work rolls of a next adjacent rolling mill stand to bite the thus reduced hot material strip leading end portion, said reducing including operating said at least on additional rolling mill stand in a strip reducing mode, followed by operating said additional rolling mill stand in a rolling operation mode after said leading end portion has been reduced in thickness.

33. A method according to claim 32, wherein said reducing comprises:

opening a roll gap of said at least one additional rolling mill stand to such an extent as to be larger than a thickness of said hot material strip supplied from the rough rolling mill, passing said material strip through roll biting portions of said at least one additional rolling mill stand, stopping said hot material strip at a position upstream of the next adjacent rolling mill stand, and withdrawing said material strip to an entry side of said at least one additional rolling mill stand while said roll gap is closed and a certain amount of draft is applied to thereby thin the leading end portion of said material strip.

34. A method according to claim 33, wherein:

said hot material strip is withdrawn to an entry side of said hot finish rolling mill, and offset of work rolls of said at least one additional rolling mill stand is changed over to an entry side.

35. A method according to claim 33, comprising subsequently moving said thin leading end portion back into said at least one additional rolling mill stand to carry out said finish rolling.

* * * * *